US011816959B2

(12) United States Patent
Djemal et al.

(10) Patent No.: US 11,816,959 B2
(45) Date of Patent: Nov. 14, 2023

(54) GAMING MACHINE AND METHOD FOR STACK ACTIVATED PRIZES

(71) Applicant: Ainsworth Game Technology Limited, Newington (AU)

(72) Inventors: Ozbay Djemal, Newington (AU); Sujay Prabhu, Newington (AU); Pairatch Paotrukal, Panania (AU)

(73) Assignee: Ainsworth Game Technology Limited, Newington (AU)

( * ) Notice: Subject to any disclaimer, the term of this patent is extended or adjusted under 35 U.S.C. 154(b) by 68 days.

(21) Appl. No.: 17/174,770

(22) Filed: Feb. 12, 2021

(65) Prior Publication Data

US 2022/0262206 A1 Aug. 18, 2022

(51) Int. Cl.
*G07F 17/32* (2006.01)

(52) U.S. Cl.
CPC ..... *G07F 17/3267* (2013.01); *G07F 17/3213* (2013.01); *G07F 17/3258* (2013.01)

(58) Field of Classification Search
None
See application file for complete search history.

(56) References Cited

U.S. PATENT DOCUMENTS 10,109,151 B2 * 10/2018 San ..... G07F 17/3267
10,332,334 B2 6/2019 Bolling, Jr. et al.
2003/0162585 A1 * 8/2003 Bigelow, Jr. ..... G07F 17/34 463/20
2006/0068884 A1 * 3/2006 Baerlocher ..... G07F 17/3267 463/20
2012/0115565 A1 * 5/2012 Schwerdling ..... G07F 17/3267 463/20
2013/0217463 A1 * 8/2013 Hughes ..... G07F 17/34 463/20
2017/0032611 A1 * 2/2017 Luong ..... G07F 17/3258
2018/0240303 A1 * 8/2018 San ..... G07F 17/3227
2019/0130704 A1 * 5/2019 Cormack ..... G07F 17/3213
2020/0111328 A1 * 4/2020 Bland ..... G07F 17/3213
2020/0250923 A1 * 8/2020 Ceniceroz ..... G07F 17/3225
2020/0265680 A1 * 8/2020 Chan ..... G07F 17/3213

* cited by examiner

*Primary Examiner* — Milap Shah
(74) *Attorney, Agent, or Firm* — Cook Alex Ltd.

(57) ABSTRACT

A gaming machine includes a display for displaying a game including game symbols arranged into an array of game positions. A game controller controls the display of randomly selected game symbols on the display in an array of game positions, preferably arranged into reels. One or more bonus positions are also displayed above the reels, the bonus positions each being associated with a reel. The bonus positions each display a bonus symbol associated with a game enhancing element, such as a credit prize, multiplier, free games or a jackpot. When a special symbol is displayed in each game position of a reel, the controller must award the game enhancing element associated with the bonus symbol displayed in the bonus position associated with the reel. A method is also provided.

17 Claims, 17 Drawing Sheets

GAMING MACHINE AND METHOD FOR STACK ACTIVATED PRIZES

BACKGROUND

The present disclosure relates to a gaming machine and method. Embodiments of the present disclosure has been developed primarily for use as an electronic gaming machine and will be described hereinafter by reference to this application. However, it will be appreciated that embodiments of the present disclosure may also be implemented for any type of gaming machine, including a mechanical or electro-mechanical gaming machine.

The following discussion of the prior art is intended to present embodiments of the present disclosure in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

One type of gaming machine comprises a mechanical or electro-mechanical device, where a motor rotates a plurality of annular rings or drums that form reels. Each reel has a reel strip that displays game symbols in preset game symbol positions. A frame covers the rings to provide a window through which only a subset of game symbol positions (and hence game symbols) were visible to the player. Thus, for a game using a 5×3 array, the window would only permit three rows of five rings to be visible to create the game array. An internal electronic controller within the gaming machine controls operation of the motor and hence rotation of the reels. Thus, by controlling when each reel starts and stops in its respective rotation, the electronic controller controls the display of the game symbols in the window. Sensors linked to the reels indicate which game symbols are displayed in the window and communicate with the electronic controller so that the electronic controller is able to award prizes based on winning combinations of game symbols displayed on the reels in the window. The electronic controller typically comprises one or more electric circuits for controlling various functions of the gaming machine, such as the above mentioned control of the motor, communicating with the sensors, verifying that the correct amount of a bet has been made via one or more value receiving mechanisms to enable operation of the motors, controlling any visual and/or audio effects associated with operation of the gaming machine and controlling operation of various alarms to alert any tampering with the gaming machine.

Another type of gaming machine, known as an electronic gaming machine or EGM, replaces the mechanical reels and motor with a video display screen on which video images of the reels are displayed. The EGM has an internal electronic game controller, typically a computer, that controls the display of images on the video display screen so that the reels are visibly spun on the screen to simulate a physical reel of a traditional gaming machine. EGMs tend to be more versatile in providing game information, varying the probabilities for a player to win a prize and varying the type of game that is played.

Bonus or "feature" games may also be provided by a gaming machine in addition to a base or main game. Typically feature games use the same set of reels as the main game and are limited to a set of free games operated under a single set of rules. This means that the feature game is restricted by the same set of rules, and so there is no variation in the play of the feature game. Also, gaming machines can offer one or more bonus prizes to the player during play of the game. The most common type of bonus prize that is awarded by the gaming machine is a jackpot prize, the main example of which is a progressive jackpot prize.

This standard structure to game play and bonus prizes limits the operation of the gaming machine, irrespective of whether it is a mechanical, electro-mechanical or electronic gaming machine. Consequently, it is difficult to retain player interest because there is no apparent incentive for the player to continue playing the gaming machine once the player becomes familiar with the feature game, the main game and any bonus prizes.

It is an object of the present disclosure to overcome or substantially ameliorate one or more of the disadvantages of prior art, or at least to provide a useful alternative.

SUMMARY

The present disclosure provides a gaming machine that has improved operation and performance relative to existing prior art gaming machines by providing a more efficient way of awarding prizes to a player of the gaming machine and/or optimising the use of screen space for the gaming machine compared to presently existing gaming machines. Embodiments of the present disclosure also improves the application of an electronic controller in playing the game on the gaming machine.

One embodiment of the present disclosure provides a gaming machine comprising:

- a display for displaying a game, wherein the game comprises randomly selected game symbols displayed in an array of game positions arranged in one or more groups, and where predetermined winning combinations of the randomly selected game symbols in the game award prizes to a player; and
- a controller for controlling the display of the game symbols on the display;
- wherein the controller is configured to display one or more bonus positions on the display, at least one of the bonus positions being associated with at least one group, the one or more bonus positions being configured to display bonus symbols associated with one or more game enhancing elements in the game; and
- wherein, in response to a special symbol being displayed in each game position of the at least one group, the controller awards the game enhancing element associated with the bonus symbol displayed in the bonus position associated with the at least one group.

Another embodiment of the present disclosure provides a gaming machine comprising:

- a display for displaying a game, wherein the game comprises randomly selected game symbols displayed in an array of game positions and where predetermined winning combinations of the randomly selected game symbols in the game award prizes to a player; and a controller for controlling the display of the game symbols on the display, wherein the controller is configured to:

cause the array to be shown on the display with the game positions arranged into one or more groups;

cause one or more bonus positions to be shown on the display, the one or more bonus positions each displaying a bonus symbol associated with a game enhancing element;

associate at least one bonus position with at least one group;

randomly select the game symbols for display in the game positions of the array;

randomly select the bonus symbols for display in the bonus positions;

cause the display to display the randomly selected game symbols and bonus symbols;

determine whether a special symbol is displayed in each game position of the at least one group; and in response to the special symbol being displayed in each game position of the at least one group, always award the game enhancing element associated with the bonus symbol displayed in the bonus position associated with the at least one group.

A further embodiment of the invention provides a gaming machine comprising:

a display for displaying a game, and;

a controller for controlling the display of the game symbols on the display; and a value transfer mechanism for receiving value from a player, wherein the controller is in communication with the value transfer mechanism;

wherein the controller is configured to:

determine if a wager has been received via the value transfer mechanism;

display a play of the game on the display including one or more configurations of game symbols if the wager has been received, one or more of the configurations of game symbols being associated with a game outcome, the game outcome being associated with a value award payable to a player;

provide an array of game positions in which to display the one or more configurations of game symbols; the game positions being arranged into one or more groups;

provide one or more bonus positions, the bonus positions each displaying a bonus symbol associated with a game enhancing element;

associate at least one bonus position with at least one group;

display randomly selected bonus symbols in the bonus positions;

determine whether a special symbol is displayed in each game position of the at least one group; and in response to the special symbol being displayed in each game position of the at least one group, always award the game enhancing element associated with the bonus symbol displayed in the bonus position associated with the at least one group.

An additional embodiment of the present disclosure provides a gaming machine comprising:

a display for displaying a game, wherein the game comprises randomly selected game symbols displayed in an array of reels, each reel having a plurality of game positions, and where predetermined winning combinations of the randomly selected game symbols in the game award prizes to a player;

a game controller for controlling the display of the game symbols on the display;

a value transfer mechanism for receiving value from the player, wherein the value transfer mechanism comprises at least one of a coin slot or acceptor, a paper currency acceptor, a ticket reader and/or printer or a card reader and/or writer; and a plurality of buttons in communication with the game controller to receive and transmit player commands to the game controller to play the game;

wherein the game controller is in communication with the value transfer mechanism such that when a threshold amount of value has been received from the value transfer mechanism, the electronic controller initiates a play of the first game;

wherein the controller is configured to display one or more bonus positions on the display, at least one of the bonus positions being associated with at least one reel, the one or more bonus positions being configured to display bonus symbols associated with one or more game enhancing elements in the game; and wherein, in response to a special symbol being displayed in each game position of the at least one reel, the game controller awards the game enhancing element associated with the bonus symbol displayed in the bonus position associated with the at least one reel.

Yet another embodiment of the present disclosure provides a method comprising:

displaying game symbols for playing a game, wherein the game comprises game symbols and predetermined winning combinations of randomly selected game symbols award prizes to a player;

providing an array of game positions to display game symbols, the game positions being arranged into one or more groups;

providing one or more bonus positions, the bonus positions each displaying a bonus symbol associated with a game enhancing element;

associating at least one bonus position with at least one group;

displaying randomly selected game symbols in the game positions of the array;

displaying randomly selected bonus symbols in the bonus positions;

determining whether a special symbol is displayed in each game position of the at least one group; and where the special symbol is displayed in each game position of the at least one group, always awarding the game enhancing element associated with the bonus symbol displayed in the bonus position associated with the at least one group.

A further embodiment of the present disclosure provides a method of operating a gaming machine comprising a display for displaying a game, a value transfer mechanism for receiving value from a player and a controller for controlling the display of the game symbols on the display, the method comprising:

the controller communicating with the value transfer mechanism to determine if a wager has been received via the value transfer mechanism;

the controller communicating with the display to:

display a play of the game on the display including one or more configurations of game symbols if the wager has been received, one or more of the configurations of game symbols being associated with a game outcome, the game outcome being associated with a value award payable to a player;

display an array of game positions to display the game symbols, the game positions being arranged into one or more groups;

display one or more bonus positions, the bonus positions each displaying a bonus symbol associated with a game enhancing element; wherein the controller:

associates at least one bonus position with at least one group;

randomly selects game symbols for display in the game positions of the array;

randomly selects bonus symbols for display in the bonus positions;

determines whether a special symbol is displayed in each game position of the at least one group; and where the special symbol is displayed in each game position of the at least one group, always awards the game enhancing element associated with the bonus symbol displayed in the bonus position associated with the at least one group.

A still further embodiment of the present disclosure provides a method comprising:

determining if a wager has been received via a value transfer mechanism;

displaying a game on the display including one or more configurations of game symbols if the wager has been received, one or more of the configurations of game symbols being associated with a game outcome, the game outcome being associated with a value award payable to a player;

providing an array of game positions in which to display the one or more configurations of game symbols; the game positions being arranged into one or more groups;

providing one or more bonus positions, the bonus positions each displaying a bonus symbol associated with a game enhancing element;

associating at least one bonus position with at least one group;

displaying randomly selected bonus symbols in the bonus positions;

determining whether a special symbol is displayed in each game position of the at least one group; and in response to the special symbol being displayed in each game position of the at least one group, always awarding the game enhancing element associated with the bonus symbol displayed in the bonus position associated with the at least one group.

A further embodiment provides a computer system comprising a central processing unit configured for communication with a gaming machine, wherein the computer system is configured to perform the method of any one of the above described embodiments of the present disclosure.

A further embodiment provides a computer program configured to perform the method of any one of the above described embodiments of the present disclosure.

A further embodiment provides a non-transitory carrier medium carrying computer executable code that, when executed on a central processing unit configured for communication with a gaming machine, causes the central processing unit to perform the method of any one of the above described embodiments of the present disclosure.

Throughout the specification and unless explicitly stated otherwise, the term "value" means credits, gaming tokens, coins, paper, currency, tickets, vouchers, credit cards, debit cards, smart cards, memory devices capable of storing value and any other object representative of value.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

The embodiments of the present disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

Figure 1:
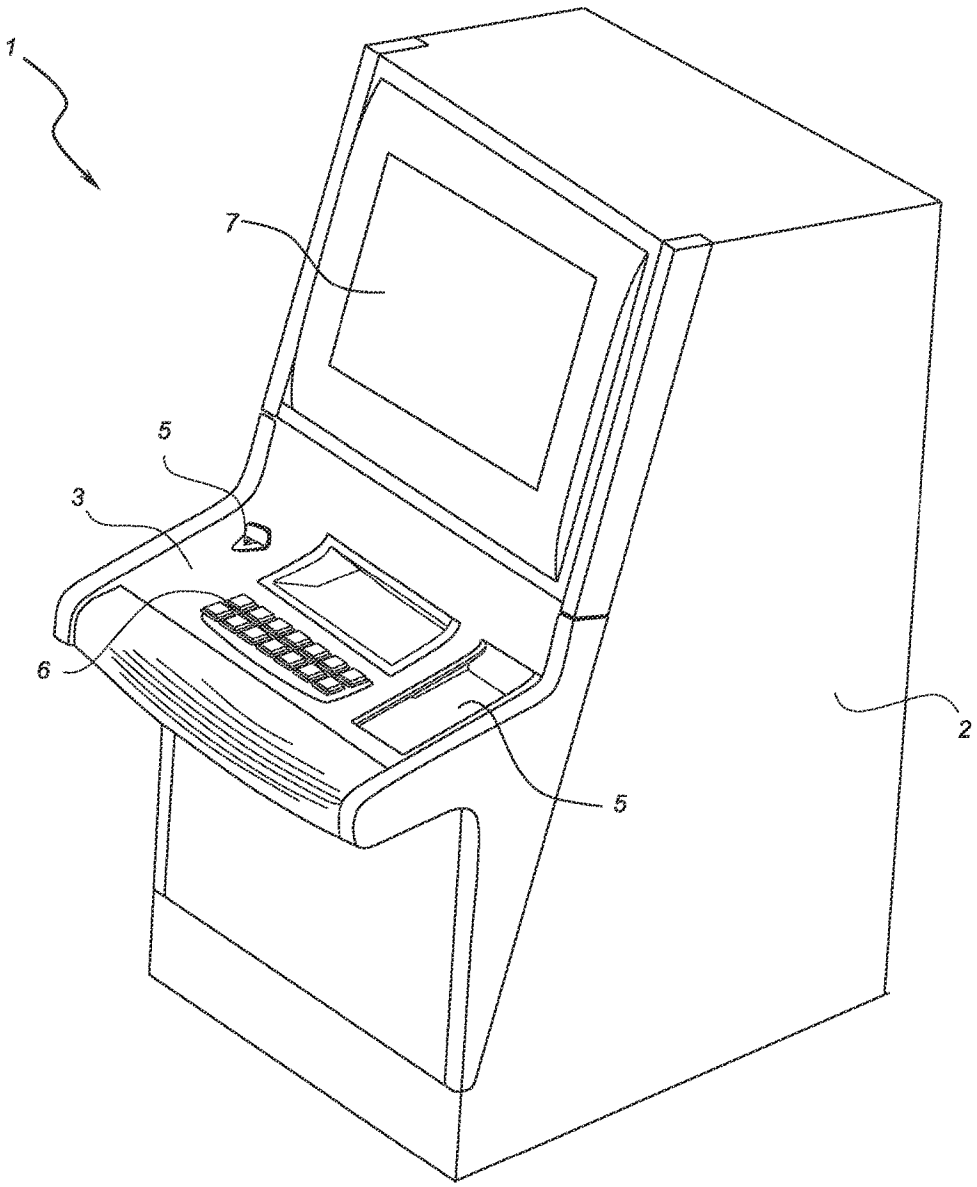
FIG. 1 is a perspective view of a gaming machine according to a first embodiment of the present disclosure.

Embodiments of the present disclosure will now be described with reference to the following examples which should be considered in all respects as illustrative and non-restrictive. In the Figures, corresponding features within the same embodiment or common to different embodiments have been given the same reference numerals.

In general terms, a gaming machine according to the embodiments described herein includes at least one display, a value transfer mechanism in the form of a value input, and an electronic controller coupled to the at least one display and the value input.

The controller is configured to determine if a wager has been received via the value input, and to display a game on the at least one display if a wager has been received. The first game includes one or more configurations of game symbols, one or more of the configurations of game symbols being associated with a game outcome, the game outcome being associated with a value award payable to a player.

Referring to FIG. 1, a gaming machine 1 according to a first embodiment of the present disclosure includes a cabinet 2, a console 3 and an internal controller 4. The console 3 has various input devices including vending slots 5 for receiving monetary bets and a plurality of buttons 6 for actuation by a player. It will be appreciated that in other embodiments the vending slots 5 may be replaced with other types of value transfer mechanism or value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the gaming machine 1. Other forms of value include gaming tokens, paper, tickets, vouchers, and any other object representative of value.

In this embodiment, the buttons 6 are physical buttons provided on the console 3. However, it will be appreciated that the buttons 6 can be replaced with virtual buttons on the display 7 that are touch sensitive surfaces for receiving commands from the player, the touch sensitive surfaces or virtual buttons being in electronic communication with the controller 4 to transmit the player commands. Alternatively, there may be a combination of buttons 6 on the console 3 and touch sensitive surfaces or virtual buttons on the display 7.

Figure 2A:
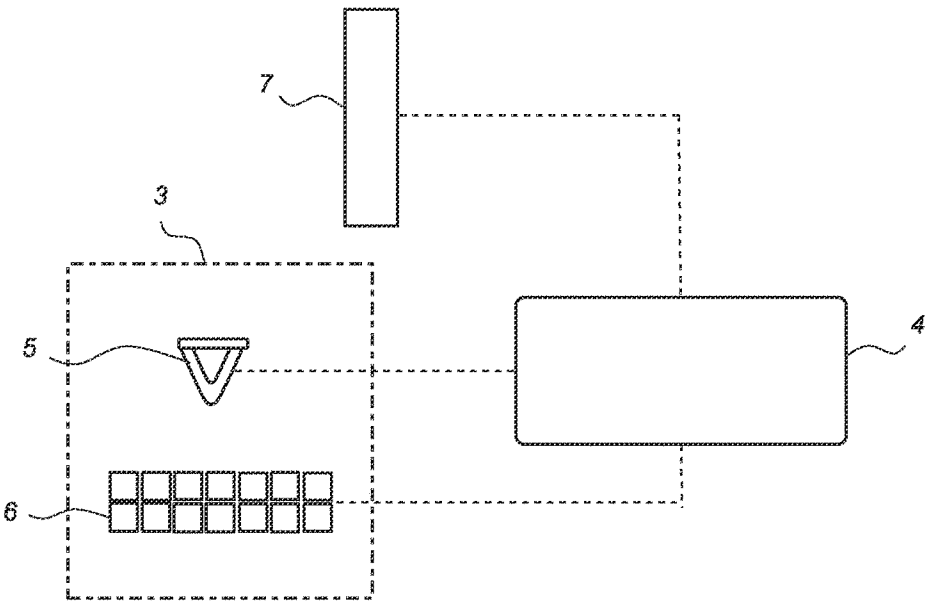
FIG. 2A is a schematic drawing of a controller, input devices and display for the gaming machine of FIG. 1.
Figure 2B:
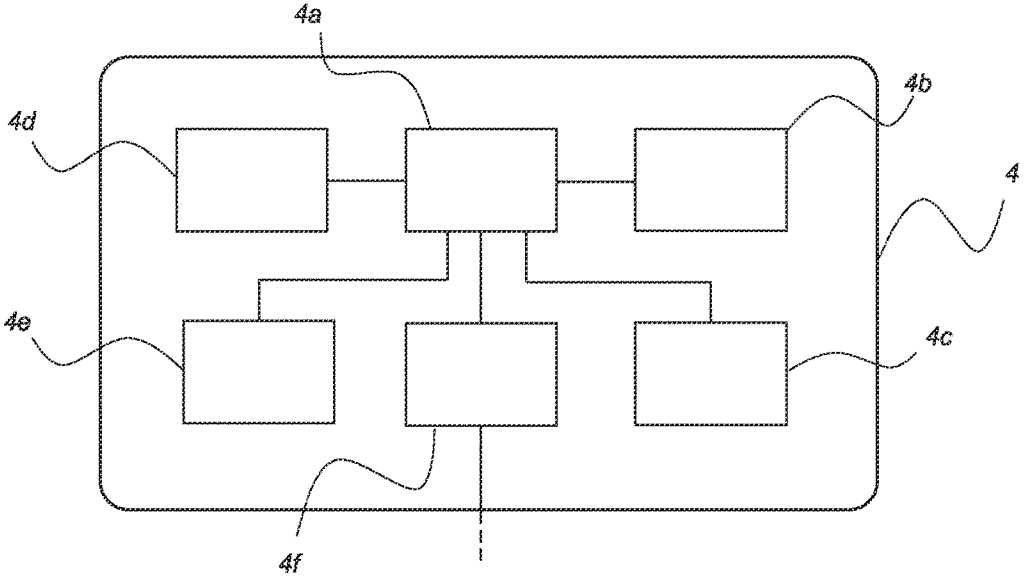
FIG. 2B is a schematic drawing of the controller for the gaming machine of FIG. 2A.

The controller 4 is generally in the form of an electronic controller comprising a central processing unit, such as a computer, and is in electronic communication with a display in the form of a video display screen 7, as well as the various input devices on the console 3, as best shown in FIG. 2A. Typically, the electronic controller 4 also comprises a processor 4*a*, a random access memory (RAM) 4*b* and a further storage memory 4*c*, the RAM and storage memory being operatively associated with the processor 4*a*. The RAM 4*b* is used to store program instructions and transient data related to the operation of the electronic controller and hence the gaming machine 1. The RAM 4*b* contains a body of program instructions for implementing a game on the gaming machine 1, as discussed in more detail below. The further storage memory 4*c*, which may take the form of a hard disk drive, is used for long-term storage of program components and data relating to the electronic controller 4 and/or the gaming machine 1, including firmware, a database for game performance data, as well as information gathered from users. The electronic game controller 4 may also comprise modules to assist in exercising functions in relation to the operation of the gaming machine 1, including a metering module 4*d* for monitoring operation of the gaming machine in compliance with regulatory requirements, the amount of player credit and the credits available to play the gaming machine; a random number generator 4*e* for enabling the game controller to make random decisions, as may be required from time to time by the gaming machine to implement a game; and an input/output interface 4*f* for communicating with peripheral devices, including input devices like the value transfer mechanism 5 and buttons 6. It is also appreciated that a person skilled in the art would readily understand the location and use of the electronic controller 4 in the gaming machine 1.

The electronic controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic controller 4, which then determines whether the minimum bet level has been reached. If so, the electronic controller 4 will permits play of the game on the gaming machine 1. If not, the electronic controller 4 will send a signal to the display 7 to show a message requesting further value to be added to the gaming machine 1.

Figure 3:
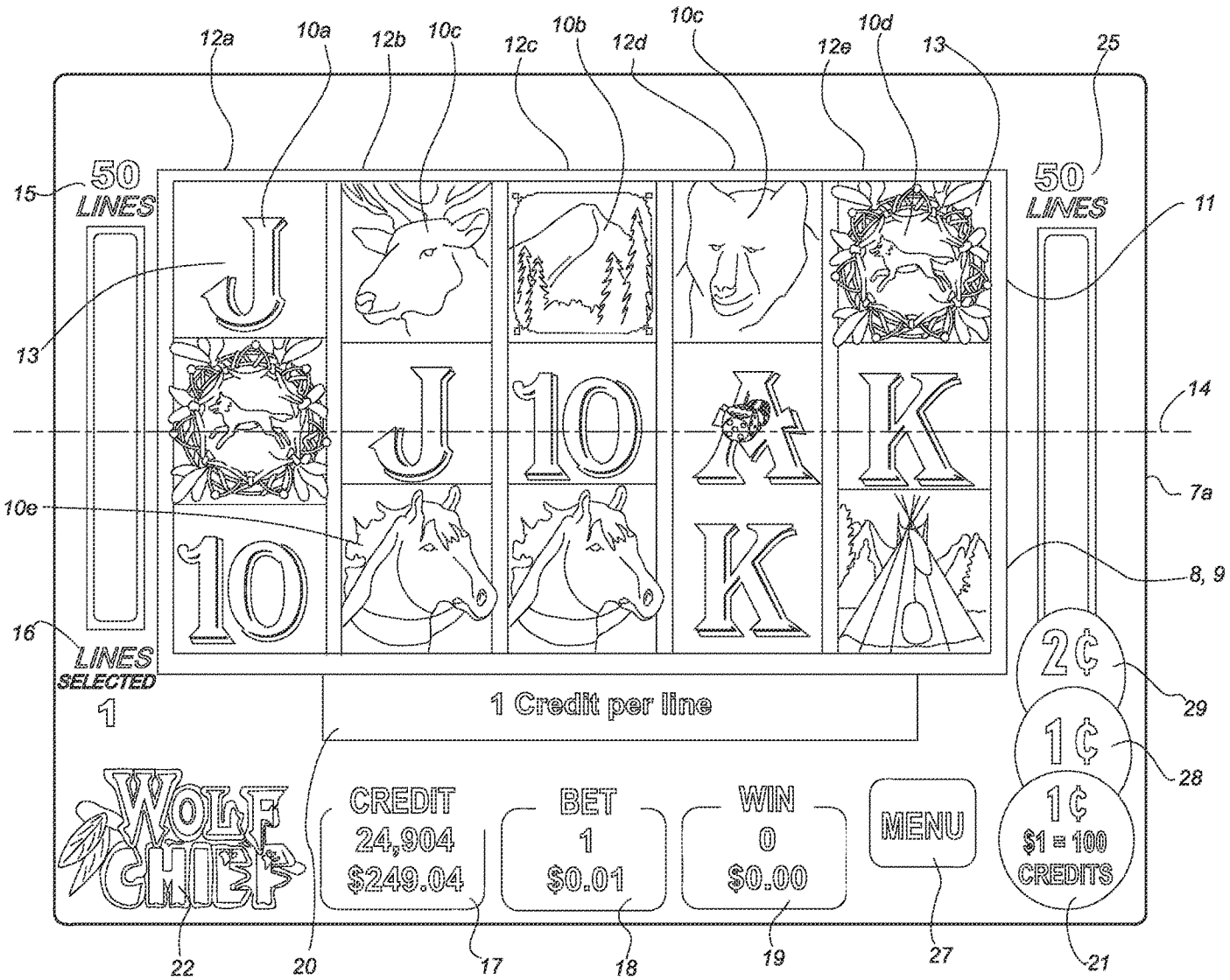
FIG. 3 is a front view of the display of the gaming machine of FIG. 1 illustrating a base game.
Figure 4:
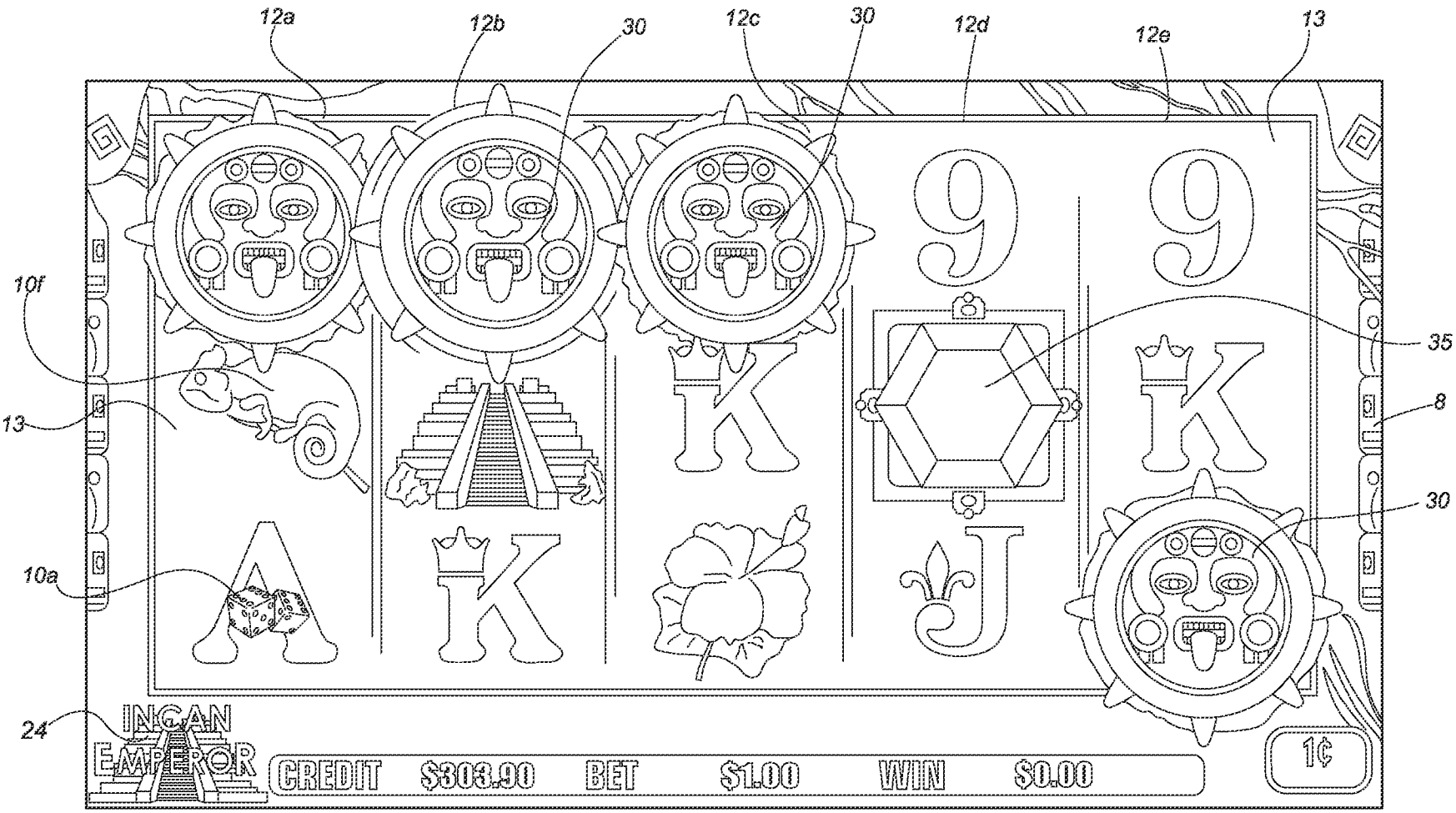
FIG. 4 is a front view of the display of the gaming machine of FIG. 1 illustrating another base game.

The electronic controller 4 is programmed to provide a game in the form of a base game 8 (as best shown in FIGS. 3 and 4) and a feature game 9 (as best shown in FIGS. 5 to 15) on a lower playing area 7*a* of the display 7 of the gaming machine 1 for play by a player. An upper display area (not shown) is reserved for showing artwork associated with the game(s) that are available for play on the gaming machine and/or other game information. The base game 8 has game symbols 10 arranged into an array 11 in the form of five columns or "reels" 12. The reels 12 give the visual appearance of rotating, typically by having the game symbols 10 move in a downward linear path along the length of each reel 12. While the array 11 is arranged with five reels 12 and three rows as per the industry standard, it will be appreciated by one skilled in the art that other types of arrays could be used, such as 3×3, 4×3, 5×5, 4×4, etc., including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic controller 4 will transmit signals to the display screen 7 to cause the base game 8 and feature game 9 to be played on the lower playing area 7*a*, including showing the game symbols 10, array 11 and other visible elements of the games.

The array 11 of the base game 8 defines predetermined game or symbol positions 13, in which the game symbols 10 appear. The symbol positions 13 are not visually marked by boundary lines and simply provide an area for the game symbols 10 to appear. However, it will be appreciated that in other embodiments, the symbol positions 13 are defined by visible boundary lines (to define "squares" or game positions) or other markings to define each respective area of the symbol positions.

The array 11 is arranged so that a player can select one or more predetermined "pay lines" 14 defined around the array, which correspond to combinations of the symbol or game positions 13, one example of which is illustrated in FIG. 3. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 result in the award of prizes to the player.

The game symbols 10 can include a mixture of picture symbols (such as animal symbols or playing card symbols), word symbols, scatter symbols, substitute or wild card symbols and trigger symbols to trigger the feature game 9. Those skilled in the art will readily understand that a substitute symbol is able to act as any other game symbol, and hence is also known as a "wild card" symbol. Likewise, those skilled in the art will readily understand that a scatter symbol is a symbol that triggers a game event or confers an award without having to appear on a player-selected pay line 14. Similarly, a trigger symbol is a symbol that triggers a game event or confers an award, where the trigger symbol may or may not have to appear in combination and may or may not have to appear on the same player-selected pay line 14. In this embodiment, the game symbols 10 include playing card symbols 10*a*, animal-themed symbols 10*b*, item-themed symbols 10*c*, scatter symbols in the form of Wolf Flag symbols 10*d* and a substitute or wild card symbol in the form of Horse symbols 10*e*. The electronic controller 4 randomly determines the appearance of the game symbols 10 on the array 11.

The video screen 7 also displays other standard game information in the lower playing area 7*a*, including the number of pay lines available 15, the number of player-selected pay lines 16, the amount of player credits (i.e. credit meter 17), the amount of the current bet wagered by the player (i.e. bet meter 18), the amount of wins by the player (i.e. win meter 19), a message area 20, a current denomination button 21 indicating the currently selected base bet denomination and the name 22 of the brand or type of game that the base game 8 belongs to, being Wolf Chief™, as best shown in FIG. 3. If there is an insufficient amount of the monetary bet or value, the electronic controller 4 will cause the display 7 to display a message to the effect that there is insufficient credit to play the game. Alternatively or additionally, the credit meter 17 is highlighted by an animation or flashing lights to indicate that additional value needs to be entered before the game 8 can be played.

In other embodiments, the video screen 7 displays a virtual menu button for bringing up a menu screen (typically explaining the game rules and showing the available pay lines 14) and/or jackpot information relating to the based game 8 and feature game 9 that are awarded by the electronic gaming machine 1. This jackpot information is typically displayed in the upper display area and can comprise, in descending order of monetary value, a grand jackpot, major jackpot, minor jackpot and midi jackpot.

In the base game 8, the player initially makes a bet or wager using vending slots 5 to initiate play of the gaming machine 1 by building up credit to play the base game 8 on the gaming machine. For example, the player can bet or wager monetary amounts equivalent to a particular amount of credits, depending on the bet denomination selected for the base game. Also, the player can make any additional side bets or ante-bets during play of the base game 8 once the base game has commenced to access additional features in the base game, such as increasing the number of winning combinations in the base game.

Typically, gaming machines offer a number of preset bet options that the player can make, and these bet options can vary depending on the game or games offered on the gaming machine. For example, a game on a gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc.

The gaming machine 1 also has a default bet denomination, which is usually the bet denomination that was previously used in the preceding play of the base game 8. For example, if a person had played the base game 8 with a bet denomination of 5 ¢, then this would be the default bet denomination for the player when he or she commences play of the game. Where the gaming machine has not yet been played or has been started up, the default bet denomination is initially selected by the electronic controller 4. The default bet denomination can be randomly selected or chosen according to a predetermined order. Usually, the electronic controller 4 will select the bet denomination with the lowest value that is available for the base game 8, which would be the 1¢ bet denomination for this embodiment. The player may change the bet denomination at any time in the base game 8 by touching the denomination button 21 before or after the reels 12 have spun. In this embodiment, touching the denomination button will bring denomination images that the player may select to quickly change the bet denomination between plays of the game 8.

Once the player has commenced play of the game 8 by making an appropriate bet or wager via the vending slots 5, the amount of the bet or wager is assessed by either the verification device associated with the vending slots 5 and/or the metering module 4*d*. If the amount of the bet is sufficient to at least meet the threshold of the minimum bet permitted to play the base game 8, the electronic controller 4 then commences a play of the base game 8 by sending a signal to the display 7 to cause the reels 12 to appear to visibly rotate or "spin" in a linear path, typically in a downward vertical direction, and randomly display the game symbols 10 in each game position for each play of the array 11 for the base game 8. The electronic game controller 4 randomly selects the game symbols 10 using the processor 4*a* with the random number generator 4*e*. After the reels 12 stop spinning (and thus ends the spin or play of the base game 8), the electronic controller 4 determines whether there are any predetermined winning combinations of the game symbols 10 appearing in any player-selected pay lines 14, such as a two of a kind, three of a kind, four of a kind or five of a kind for all the game symbols 10 and other combinations of a "full house", "straight" or "flush" for the playing card game symbols 10*a*. It will be appreciated that other winning combinations of game symbols 10 can also be provided. If so, the gaming machine 1 enters a winning game state and awards a prize according to the displayed predetermined winning combination.

The electronic controller 4 also determines whether the feature game 9 should be activated, based on a predetermined trigger event, such as the appearance of a number of feature game trigger symbols appearing in a play or spin of the base game 8. In this embodiment, the trigger event is the appearance of three scatter symbols 10*d*; i.e. the feature game trigger symbols are the scatter symbols 10*d*. The scatter symbols 10*d* need not appear on the same pay line 14, but can appear on any of the player-selected pay lines.

In response to the trigger event, the electronic controller 4 then transmits a signal to the video screen 7 to cause the feature game 9 to appear on the video screen 7. The feature game 9 also uses the same array 11, reels 12, game positions 13 and player-selectable pay lines 14 as the base game 8 on the video screen 7. The feature game 9 operates in a similar manner to the base game 8, where the reels 12 visibly rotate and display randomly selected game symbols 10 in each game position 13. Predetermined winning combinations of randomly selected game symbols 10 in the array 11 of the feature game 9 also result in the award of prizes to the player, usually of an enhanced value compared to the prizes awarded in the base game 8, and/or with an increased frequency (i.e. the feature game 9 has higher win probability compared to the base game 8).

Referring to FIG. 4, one embodiment of the present disclosure is shown, where a base game 8 is provided under the name 24 "Incan Emperor", with an Incan theme having matching picture symbols 10*f* in the form of a chameleon, jungle flower and temple. Scatter symbols in the form of coin symbols 30 and substitute symbols in the form of an emerald symbol 35 also appear in the base game 8 in addition to playing card symbols 10*a* and picture symbol 10*f*. The base game 8 operates in substantially the same way as described in relation to FIG. 3 and so a detailed description of the base game 8 will be omitted. As described earlier above, the presence of three scatter coin symbols 30 on the reels 12 as shown in FIG. 4 is a trigger event to activate the feature game 9, which also employs the same array 11, reels 12, game positions 13 and player-selectable pay lines 14 as the base game 8. The feature game 9 also operates in a similar manner to the base game 8, where the reels 12 visibly rotate and display randomly selected game symbols 10 in each game position 13.

In the feature game 9, five free plays or spins of the feature game are awarded to the player without having to make an additional bet or wager. It will be understood by those skilled in the art that a free play or spin involves a play of the game without requiring any bet to be made by the player, and that any number of free spins can be chosen for the feature game 9. In addition, it will be appreciated that in the art free spins are commonly referred to as "free games". The number of free games remaining in the feature game 9 is indicated by a counter 29. Typically, the prizes awarded for the same winning combinations of game symbols in the feature game 9 are of higher value than the prizes awarded in the base game 8.

The feature game 9 also comprises a set of bonus positions 40 that are associated with each of the reels 12. That is, the bonus position 40*a* is associated with reel 12*a*, the bonus position 40*b* is associated with reel 12*b*, the bonus position 40*c* is associated with reel 12*c*, the bonus position 40*d* is associated with reel 12*d* and the bonus position 40*e* is associated with reel 12*e*. This association is indicated by locating each bonus position 40*a* to 40*e* adjacent their respective associated reel 12*a* to 12*e* and in this embodiment, the bonus positions 40 are located above each reel 12*a* to 12*e*.

The bonus positions 40*a* to 40*e* each display bonus symbols 45 that are associated with game enhancing elements that modify the outcome of the reel spin. In this embodiment, the bonus symbols 45 correspond to the game enhancing element that is conferred; i.e. the bonus symbols 45 describe the game enhancing element, such as MINOR jackpot or 2000 credit prize. In this embodiment, each bonus position 40*a* to 40*e* displays a default bonus symbol corresponding to the minimum level of game enhancing element that can be won, which in this embodiment is the 1500 bonus symbol 45*a* to indicate a credit prize of 1500 credits. In some embodiments, the bonus positions 40*a* to 40*e* may be blank or show a null symbol until the bonus position 40 is activated or triggered by the display of a coin symbol 30 in a game position 13 of the associated reel 12*a* to 12*e*.

In other embodiments, the bonus symbols 45 may comprise different images that are associated with each game enhancing element or type of game enhancing element, instead of being descriptive of the game enhancing element. For example, a jaguar symbol may be used to indicate a credit prize, a gold statue symbol may be used to indicate the award of additional free games/spins and a sun symbol may be used to indicate a jackpot. In another example, different jewel symbols may indicate credit prizes of different value, and so on for each game enhancing element. Generally, the game enhancing element modifies the result of a play of the feature game 9. The game enhancing elements may provide different types of effects or modifications of the game play result.

Figure 5:
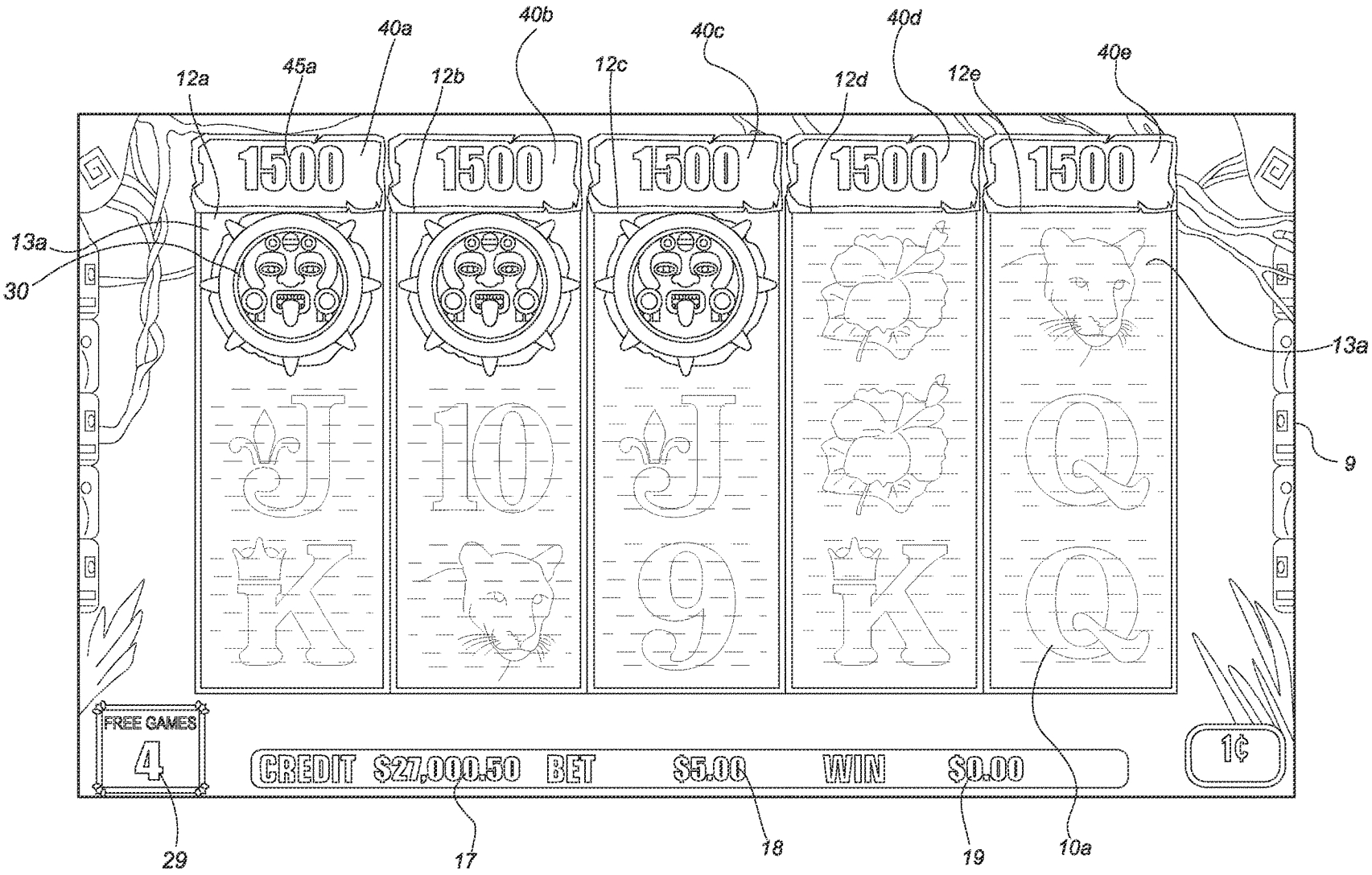
FIGS. 5 to 8 are partial simulated screen shots illustrating a feature game according to one embodiment of the present disclosure shown on the display of the gaming machine of FIG. 1.

The feature game 9 operates in a similar manner to the base game 8, where the reels 12 visibly rotate and display randomly selected game symbols 10 in each game position 13, as best shown in FIGS. 5 to 8. In this case, three coin symbols 30 appear in the top game positions 13*a* of reels 12*a*, 12*b* and 12*c*, instantly awarding a credit prize to the player, as best shown in FIG. 5. This indicated by an image of the credit prize appearing over the reels that is sent to a win meter (not shown) in the upper display area. Alternatively, the image of the credit prize is sent to the credit meter 17 and/or the win meter 19 in the lower display area 7*a*. The credit prize is calculated on the number of coin symbols 30 that appear in a free spin (not the total number of coin symbols displayed on the reels 12) and is a multiple of the total credits bet for the spin of the base game 8 that activated the feature game 9. Generally, the credit prize is calculated by multiplying the number of coin symbols 30 by a base credit prize. The base credit prize is calculated by applying a predetermined multiplier to the total credits bets. The predetermined multiplier applied to the total credits bet in this embodiment may be ×1, ×2, ×5 or ×10. The selection of the predetermined multiplier may be determined according to the number of lines and/or the bet denomination selected by the player; more lines and/or higher bet denominations will increase the multiplier. Also, a higher bet or wager made in the activating spin in the base game 8 increases the credit prize awarded in the feature game 9 for the appearance of a coin symbol 30.

While three coin symbols 30 appeared on the first play of the feature game 9, the electronic game controller 4 may randomly select whether to display game symbols 10 or coin symbols 30 for each game position 13 in the reels 12*a* to 12*e*, using the processor 4*a* with the random number generator 4*e*. Hence, more or less coin symbols 30 may appear on the reels 12, or even none at all. In this embodiment, the coin scatter symbols 30 that appeared in the base game 8 and triggered the feature game 9 carry over the first play of the feature game, as shown in FIG. 5. Hence, in FIG. 5, no additional coin symbols 30 appeared in the first play of the feature game 9.

The appearance of the three coin symbols 30 also activates the bonus positions 40*a*, 40*b* and 40*c* associated with the reels 12*a*, 12*b* and 12*c*, respectively, that show the coin symbols. This is indicated by briefly animating the bonus positions 40*a*, 40*b* and 40*c*, such as expanding and then contracting the bonus positions, flashing or other visual effect linked to the bonus positions. In other embodiments, activation of the bonus positions 40 is indicated by highlighting the bonus symbols 45*a* in the bonus positions 40*a*, 40*b* and 40*c*, or the bonus positions themselves. For example, the bonus symbols 45*a* and/or bonus positions 40*a*, 40*b* and 40*c* may be illuminated, animated or both, relative to the inactive bonus symbols and bonus positions 40*d* and 40*e*. This indicates to the player that the credit prizes associated with the bonus symbols 45*a* in the bonus positions 40*a*, 40*b* and 40*c* are now available to be won in the feature game 9.

In addition, the coin symbols 30 are kept or "held" in the same game position 13 that they initially appeared on the reels 12 for each subsequent play or free spin for the duration of the feature game 9. This "hold and spin" aspect of the feature game 9 only applies to the coin symbols 30. It should also be noted that any game symbols 10 (including picture symbols 10*f* and playing card symbols 10*a*) that appear on the reels 12 are inactive and do not contribute to any winning combination of symbols in the feature game 9; only the coin symbols 30 are able to trigger the award of credit or other prizes in the feature game 9. To emphasise this aspect of the feature game 9, the coin symbols 30 remain fully visible in the game positions 13 but the game symbols 10 are blacked out or fade into the background of the game positions, where they can only be faintly seen, such as for example the Queen symbol 10*a* in FIG. 5.

Figure 6:
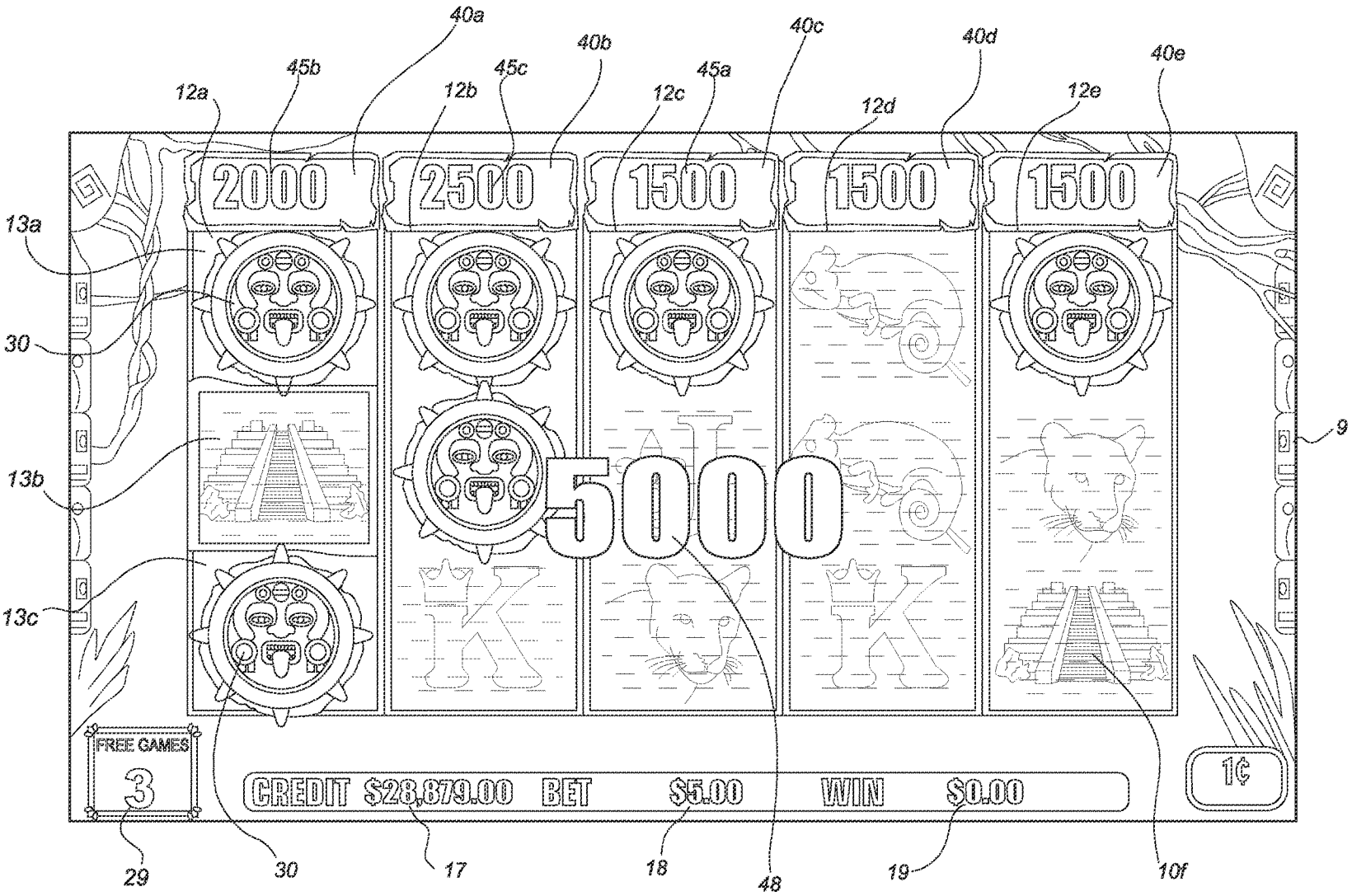

FIG. 6 illustrates the next (second) free spin of the feature game 9, where three more coin symbols 30 appear in the reel 12*a* at the bottom game position 13*c*, reel 12*b* in the middle game position 13*b* and reel 12*e* in the top game position 13*a*. As stated above, the original three coin symbols 30 from the previous free spin have been held in their respective top game positions 13*a* of reels 12*a*, 12*b* and 12*c*. Again, a credit prize of 5000 credits is awarded instantly to the player for the appearance of three coin symbols 30 and an image 48 of the credit prize is briefly shown on the reels 12 before disappearing and/or moving up to the win meter in the upper display area. In other embodiments, the image 48 floats or moves to the credit meter 17 and/or win meter 19 in the lower display area 7*a* to add the amount of the awarded credit prize to the credit meter or win meter.

As additional coin symbols 30 appear in each free spin or play of the feature game 9, the bonus symbols 45*a* displayed in the bonus positions 40*a* to 40*e* change to different bonus symbols associated with game enhancing elements having a greater game play value. In this embodiment, the bonus symbols 45*a* change to reflect higher credit values where a coin symbol 30 appears in the reel associated with the bonus position 40 that displays for the bonus symbol. For example, in FIG. 6, the coin symbol 30 in appearing in the reel 12*a* causes the 1500 bonus symbol 45*a* in bonus position 40*a* to be replaced with the 2000 bonus symbol 45*b*, increasing the credit prize from 1500 credits to 2000 credits. Similarly, the coin symbol 30 in appearing in the reel 12*b* causes the bonus symbol 45 in bonus position 40*a* to change from 1500 to a 2500 bonus symbol 45*c*, increasing the credit prize from 1500 credits to 2500 credits. The single appearance of the coin symbol 30 in the reel 12*e* does not cause a change in the bonus symbol 45*a* shown in bonus position 40*e*, since it activates the bonus position 45*e* and reflects the credit prize available to be awarded for a single coin symbol in the reel 12*e*.

The increases in the game play values of the changing bonus symbols may be randomly determined by the electronic game controller 4 using the processor 4*a* and the random number generator 4*e*, or predetermined by game play values stored in the storage memory 4*c*. For example, there may be range of credit prize values from 200 up to 50000, a range of jackpots from mini, minor and major to grand jackpots or multipliers from ×2 up to ×15. Moreover, the bonus symbols 45 may change as the total number of coin symbols 30 appear on the reels 12, so that the game play values (such as credit prizes) in one bonus position 40 may be higher than the game play values in another bonus position 40 by virtue of a coin symbol 30 appearing on the reel associated with the bonus position later in the free spin or in a subsequent free spin or play of the feature game 9. For example, in FIG. 6, the coin symbol 30 may have appeared in the bottom game position 13*c* of the reel 12*a* first, followed by the coin symbol in the middle game position 13*b* of the reel 12*b* (this may occur where the reels 12 spin at different speeds so that each reel stops separately relative to the other reels or where each game position 13 has an independent reel strip to the other game positions, effectively making each game position a reel). This causes the bonus symbol 45 in the reel 12*b* to be higher in value (2500) to the bonus symbol 45*b* in the reel 12*a*, having a value of 2000. Additional coin symbols 30 appearing on the reels 12 in subsequent free spins of the feature game 9 will cause the bonus symbols 45 in the bonus positions 40 to jump to higher game play values.

In further embodiments, the bonus symbols 45 in the bonus positions 40 may change to display the same higher game play value where the game enhancing element has not yet been awarded. That is, once activated, each coin symbol 30 that appears on the reels 12 causes the bonus symbols 45 in each bonus position 40 to change to the same bonus symbol of higher game play value until the game enhancing element associated with the bonus symbol is awarded for one or bonus positions 40. In this case, only the bonus positions 40 for game enhancing elements that have not yet been awarded will continue to change their bonus symbols 45. Also, where the bonus symbols 45 are of different types, only those bonus symbols of the same type will change uniformly to the same bonus symbol. For example, the bonus positions 40 may display two bonus symbols 45 associated with credit prizes, one bonus symbol associated with a jackpot and two bonus symbols associated with multipliers. In this case, the two bonus symbols associated with credit prizes will change uniformly to the same bonus symbol of higher credit prize value and the two bonus symbols associated with multipliers will change uniformly to the same bonus symbol of higher multiplier value. The bonus symbol 45 associated with a jackpot may change to a jackpot of higher jackpot value.

In yet another embodiment, the bonus symbols 45 may change their game play values in the bonus positions 40 randomly in stepwise increments, depending on which free spin is occurring in the feature game 9. For example, the bonus symbols 45 have an initial game play value of, for example, 1500 credits for the first five free games (i.e. free games or spins 1 to 5), then change in game play value to 2500 credits for the next five free games (i.e. free games or spins 6 to 10), and increment by 2000 credits each time for each set of five free game until the feature game 9 ends.

In a further embodiment, the game play values of the bonus symbols 45 are predefined multiples of the total bet until they reach a capped amount or a jackpot value. An example of this embodiment additionally employing incrementing game play values for the bonus symbols 45 in the bonus positions 40 after a set amount of free games is shown in Table 1 below.

TABLE 1

Prize Increment Table

| Free Spin | Reel 1 Bonus value | Reel 2 Bonus value | Reel 3 Bonus value | Reel 4 Bonus value | Reel 5 Bonus value |
|---|---|---|---|---|---|
| Spin 1 | ×2 Total bet | ×2 Total bet | ×2 Total bet | ×2 Total bet | ×2 Total bet |
| Spin 2 | ×3 Total bet | ×3 Total bet | ×3 Total bet | ×3 Total bet | ×3 Total bet |
| Spin 3 | ×5 Total bet | ×5 Total bet | ×5 Total bet | ×5 Total bet | ×5 Total bet |
| Spin 4 | ×8 Total bet | ×8 Total bet | ×8 Total bet | ×8 Total bet | ×8 Total bet |
| Spin 5 | ×10 Total bet | ×10 Total bet | ×10 Total bet | ×10 Total bet | ×10 Total bet |
| Spin 6 | Capped at | ×15 Total bet | ×15 Total bet | ×15 Total bet | ×15 Total bet |
| Spin 7 | ×10 Total | ×20 Total bet | ×20 Total bet | ×20 Total bet | ×20 Total bet |
| Spin 8 | bet | ×25 Total bet | ×25 Total bet | ×25 Total bet | ×25 Total bet |
| Spin 9 | | Capped at | ×40 Total bet | ×40 Total bet | ×40 Total bet |
| Spin 10 | | ×25 Total bet | ×50 Total bet | ×50 Total bet | ×50 Total bet |
| Spin 11 | | | Capped at | ×100 Total bet | ×100 Total bet |
| Spin 12 | | | ×50 Total bet | Major Jackpot | Major Jackpot |
| Spin 13 onwards | | | | Capped at Major Jackpot | Grand Jackpot |

Figure 7:
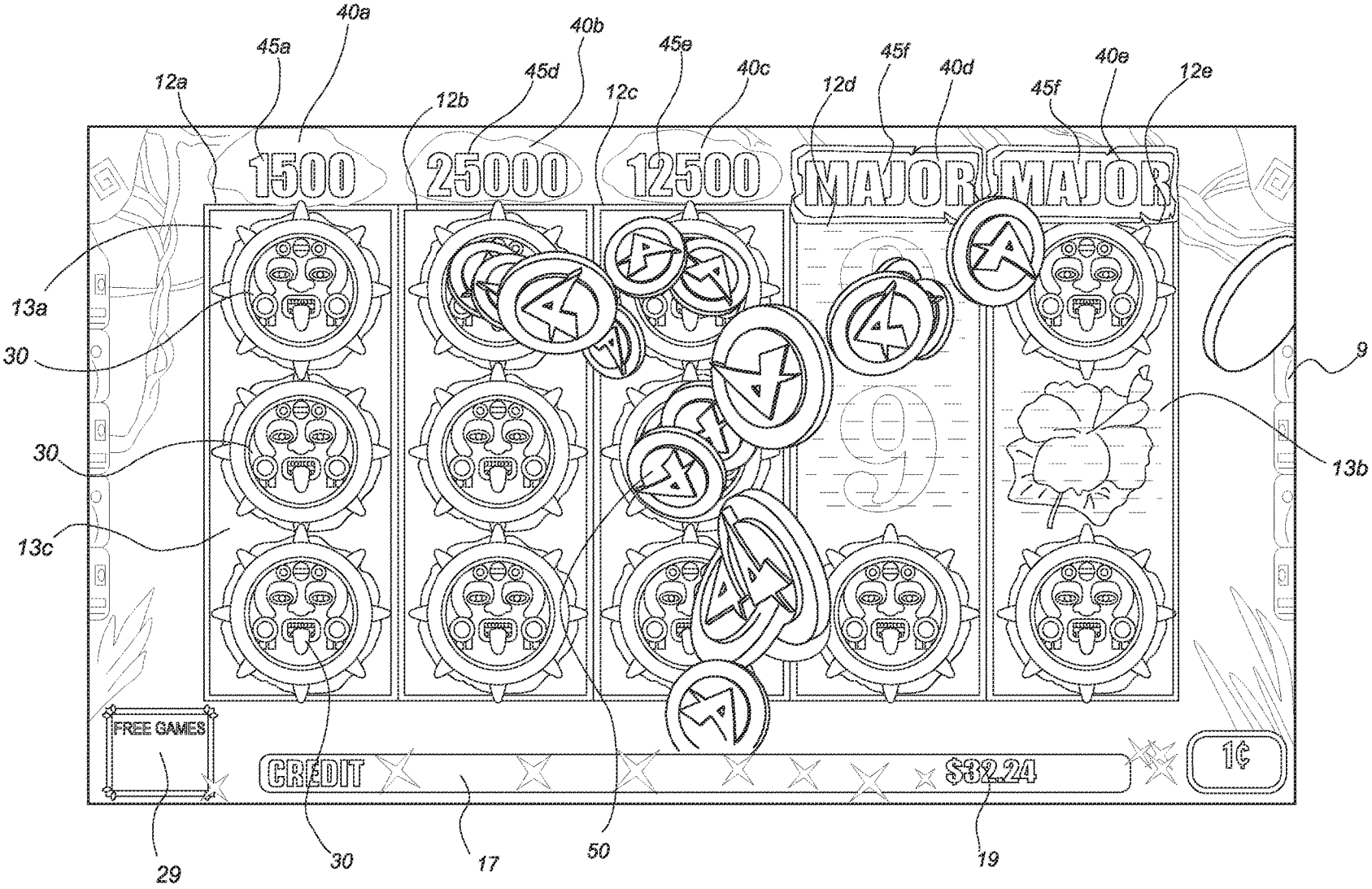

Once a coin symbol 30 appears in each game position 13 of a reel 12 to form a "stack" of coin symbols filling the reel, this causes the game enhancing element associated with the bonus symbol 45 in the bonus position 40 to be immediately awarded to the player. This is best shown in FIG. 7, which illustrates a free spin or play later in the feature game 9. As can be seen in the Figure, coin symbols 30 have appeared in each game position 13 of reels 12*a*, 12*b* and 12*c*, completing three stacks of coin symbols. Consequently, the 1500 bonus symbol 45*a*, the 25000 bonus symbol 45*d* and the 12500 bonus symbol 45*e* light up in the bonus positions 40*a*, 40*b* and 40*c* associated with the reels 12*a*, 12*b* and 12*c*, respectively. Each of the credit prizes associated with the bonus symbols 45*a* are then awarded to the player—being credit prizes of 1500, 25000 and 12500 credits, totalling 39000 credits. A winning animation 50 is displayed over the reels 12 and an image of each individual credit prize is initially shown appearing over the reels 12 and then travels towards win meter in the upper display area, or alternatively to the credit meter 17 and/or win meter 19. If a coin symbol 30 had appeared in the middle game position 13*b* of the reel 12*e*, the stack of coin symbols in the reel 12*e* would have been completed and the player would be awarded the major jackpot associated with the MAJOR bonus symbol 45*f*.

Figure 8:
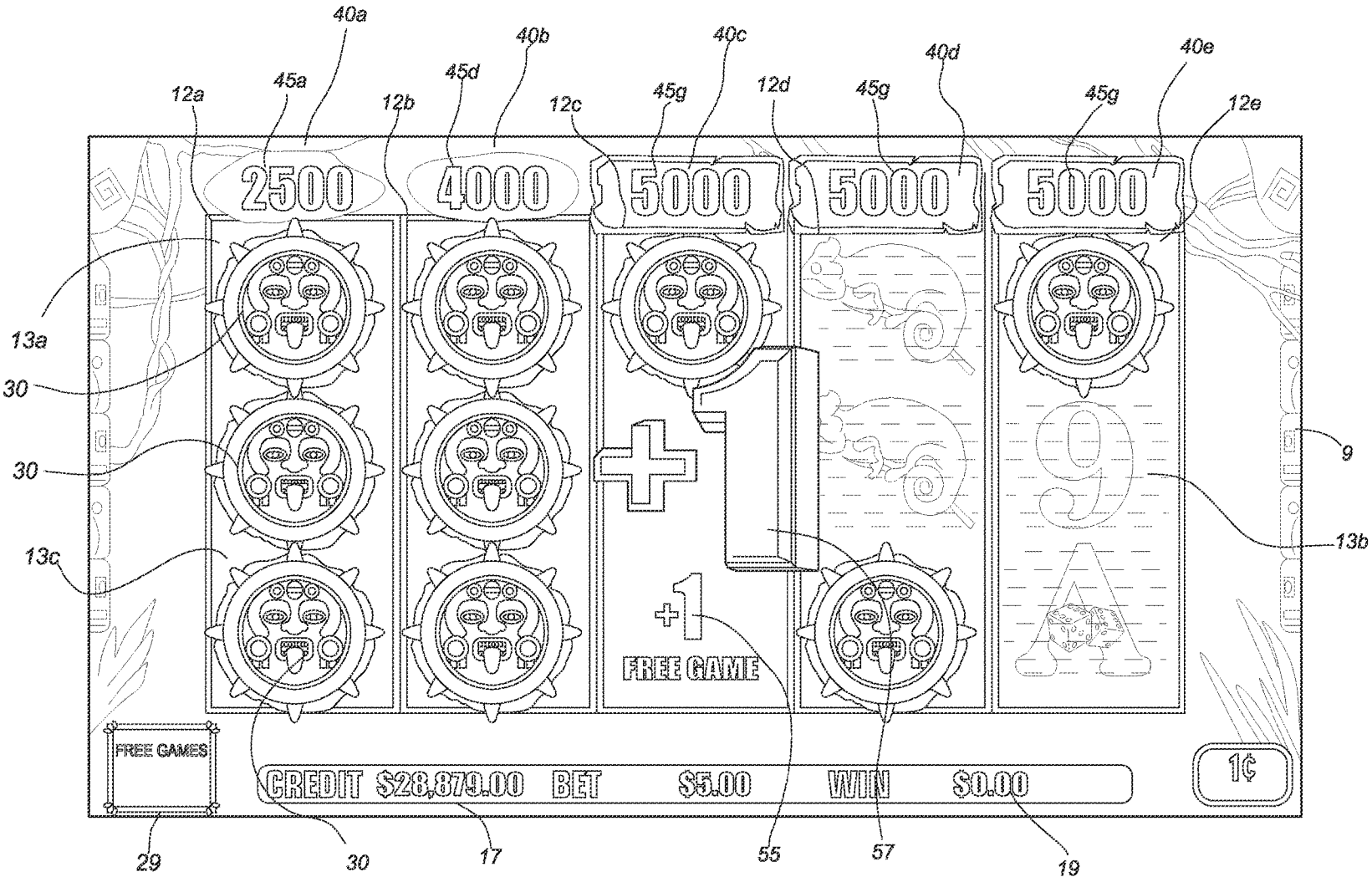

In addition to the game symbols 10*a*, 10*f* and the coin symbol 30, a free games symbol 55 may also be randomly selected by the electronic game controller 4 to appear in the game positions 13 of the reels 12. The appearance of the free games symbol 55 increases the number of free spins remaining in the feature game 9, as best shown in FIG. 8. In the figure, two free games symbols 55 have appeared in the middle and bottom game positions 13*b* and 13*c* of the reel 12*c*. The free games symbols 55 each have a value of +1 to add an extra free spin to the feature game, increasing the number of free spins by two. This is indicated by +1 image 57 on the free games symbol 55 expanding and moving to the free games counter 29, which is incremented by the value of one for each free games symbol 55. After incrementing the free games counter 29, the free games symbol 55 may either disappear or stay in the game position 13 until the next free spin. In the embodiment, the free games symbol 55 may have values of +1, +2, +3 or +5 to increase the number of free spins or plays of the feature game 9 by the corresponding amount of 1, 2, 3 and 5, respectively. This reset of the free games counter 29 occurs independently of the number of coin symbols 30 appearing on the reels 12. FIG. 8 also illustrates the situation where the bonus positions 40*c* to 40*e* have changed their bonus symbol uniformly to display the same 5000 bonus symbol 45*g*.

Referring to FIGS. 9 to 13, another embodiment of the present disclosure is illustrated. In this embodiment, feature game 9 is triggered or activated by the appearance of three Wolf Flag trigger symbols 10*d* in the base game 8 of FIG. 3. The feature game 9 has a Christmas theme, with suitably themed picture symbols 10*f*, wild or substitute symbol in the form of a Snowman symbol 10*g* and a special in the form of Elf symbol 60. However, in other embodiments the base game 8 may share a common theme with the feature game 9.

Figure 9:
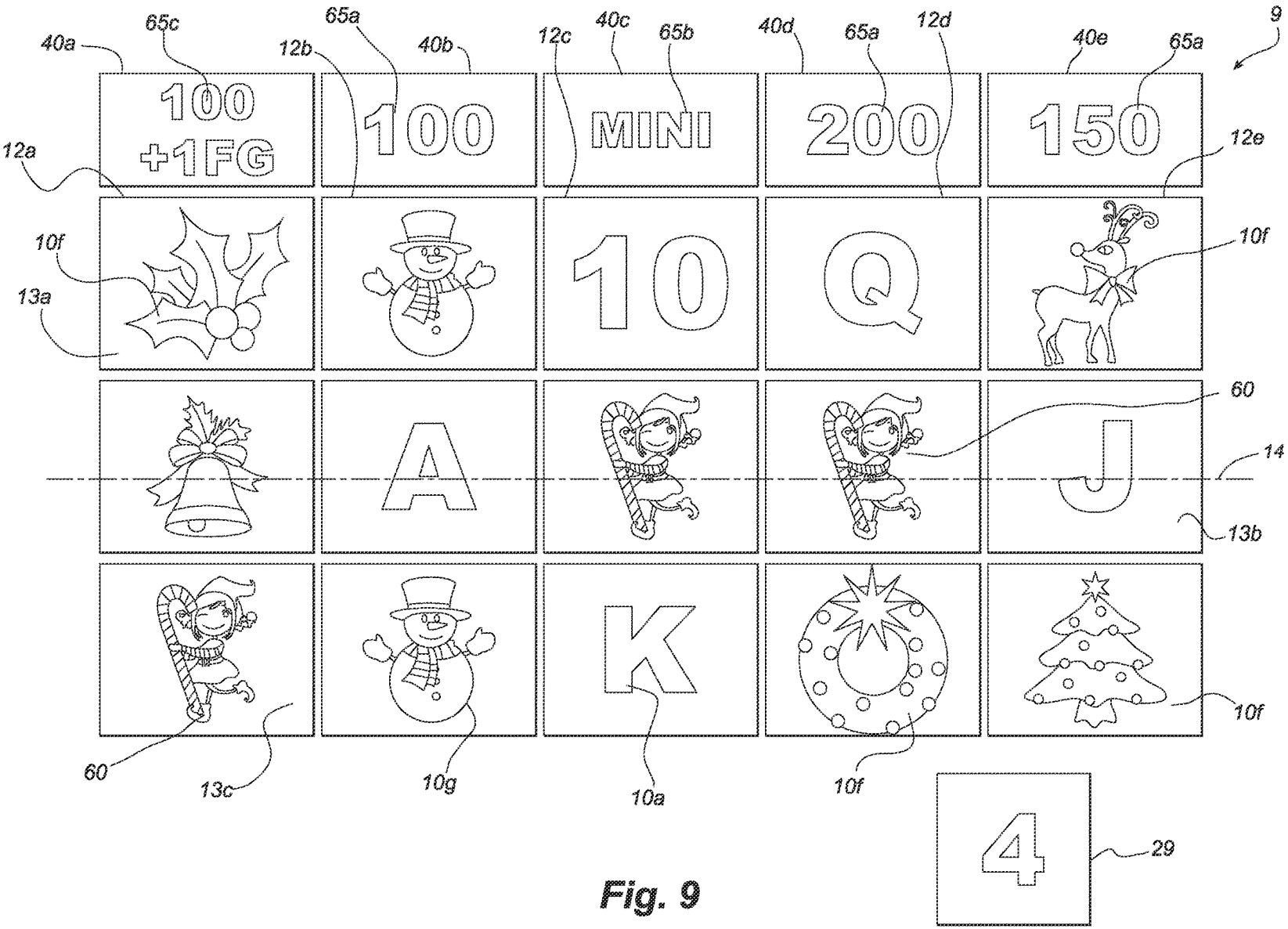
FIGS. 9 to 15 are partial simulated screen shots illustrating a feature game according to another embodiment of the present disclosure shown on the display of the gaming machine of FIG. 1.

This embodiment operates in substantially the same way as the embodiment of FIGS. 4 to 8 in that Elf symbols 60 displayed in the game positions 13 of reels 12*a* to 12*e* are kept or "held" in the same game position for the duration of the feature game 9, being five free games. Also, bonus positions 40*a* to 40*e* each display bonus symbols 45 randomly selected by the electronic game controller 4 via the processor 4*a* and random number generator 4*e*, which include credit bonus symbols 65*a*, jackpot bonus symbols 65*b* and a combined credit and free games bonus symbol 65*c*. In FIG. 9, the first free game or spin of the feature game 9 results in a 100+1 FG (free game) bonus symbol 65*c* being displayed in the bonus position 40*a*, a 100 bonus symbol 65*a* being displayed in the bonus position 40*b*, a MINI bonus symbol 65*b* being displayed in the bonus position 40*c*, a 250 bonus symbol 65*a* being displayed in the bonus position 40*d* and a 150 bonus symbol 65*a* being displayed in the bonus position 40*e*. As at least three Elf symbols 60 are displayed on the reels 12 (in the bottom game position 13*c* of reel 12*a* and the middle game positions 13*b* of the reels 12*c* and 12*d*), the bonus positions 40*a* to 40*e* are activated. However, in other embodiments, the bonus positions 40*a* to 40*c* are always active during the feature game 9 or only bonus positions 40*a*, 40*c* and 40*d* are activated.

Unlike the embodiment of FIGS. 4 to 8, in this embodiment, the prizes or game enhancing elements awarded for a stack of Elf symbols appearing in the associated reels 12*c* to 12*d* is in addition to any predetermined winning combinations of game symbols 10*a*, 10*f*, 10*g* that may be displayed on one of the pay lines 14 on the reels 12*a* to 12*e*. These winning combinations of game symbols 10*a*, 10*f* and 10*g* may either be two of a kind, three of a kind, four of a kind or five of a kind for all the game symbols 10*a*, 10*f* and other combinations of a "full house", "straight" or "flush" for the playing card game symbols 10*a*, the same as in the base game 8. The substitute Snowman symbols 10*g* only substitute game symbols 10*a*, 10*f* for winning combinations on a player-selected pay line 14 and does not substitute for the Elf symbol 60. This means that a Snowman symbol 10*g* cannot substitute for an Elf symbol 60 to complete a stack and trigger the award of a game enhancing element associated with the bonus symbols 45 displayed in the bonus positions 40*a* to 40*e*. However, the Elf symbol 60 may act as a substitute or wild symbol for the purpose of determining predetermined winning combinations of game symbols 10.

Figure 10:
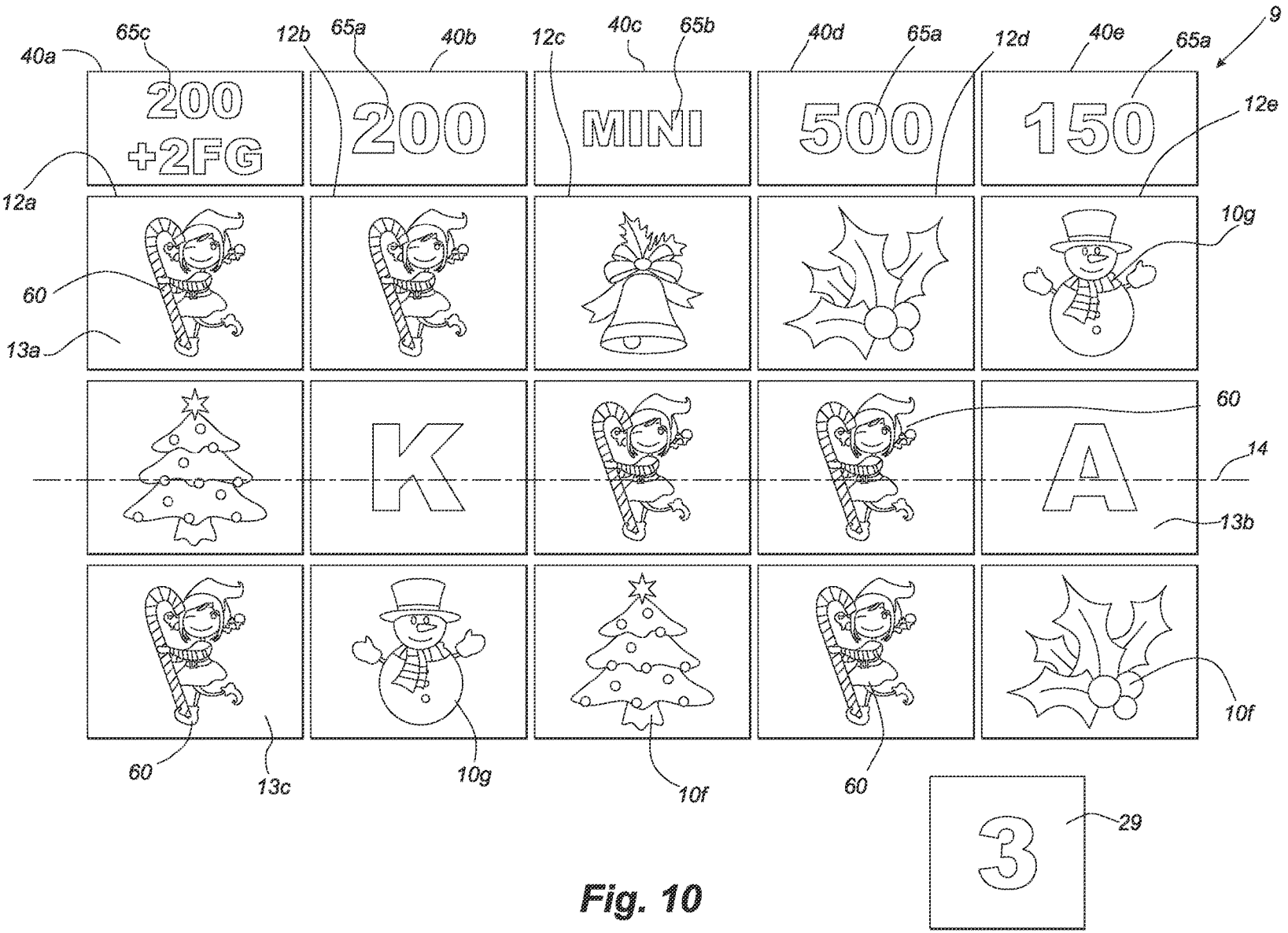

In the next free spin shown in FIG. 10, additional Elf symbols 60 have appeared in the top game position 13*a* of the reel 12*a*, the bottom game position 13*c* of the reel 12*d* and the top game position 13*a* of the reel 12*b*. This causes the bonus positions 40*a*, 40*b* and 40*d* associated with reels 12*a*, 12*b* and 12*d* to change their respective bonus symbols to bonus symbols representing higher game play values; in this case, the combined credit and free game bonus symbol 65*c* is now 200+2 FG instead of 100+1 FG, the bonus symbol 65*a* in the bonus position 40*b* is now 200 instead of 100 and the bonus symbol 65*a* in the bonus position 40*d* is now 500 instead of 200. In this spin, only predetermined winning combinations of symbols 10*a*, 10*f*, 10*g* that may be displayed on one of the pay lines 14 on the reels 12*a* to 12*e* will award prizes to the player. The free games counter 29 also shows that there are only three free spins left in the feature game 9.

Figure 11:
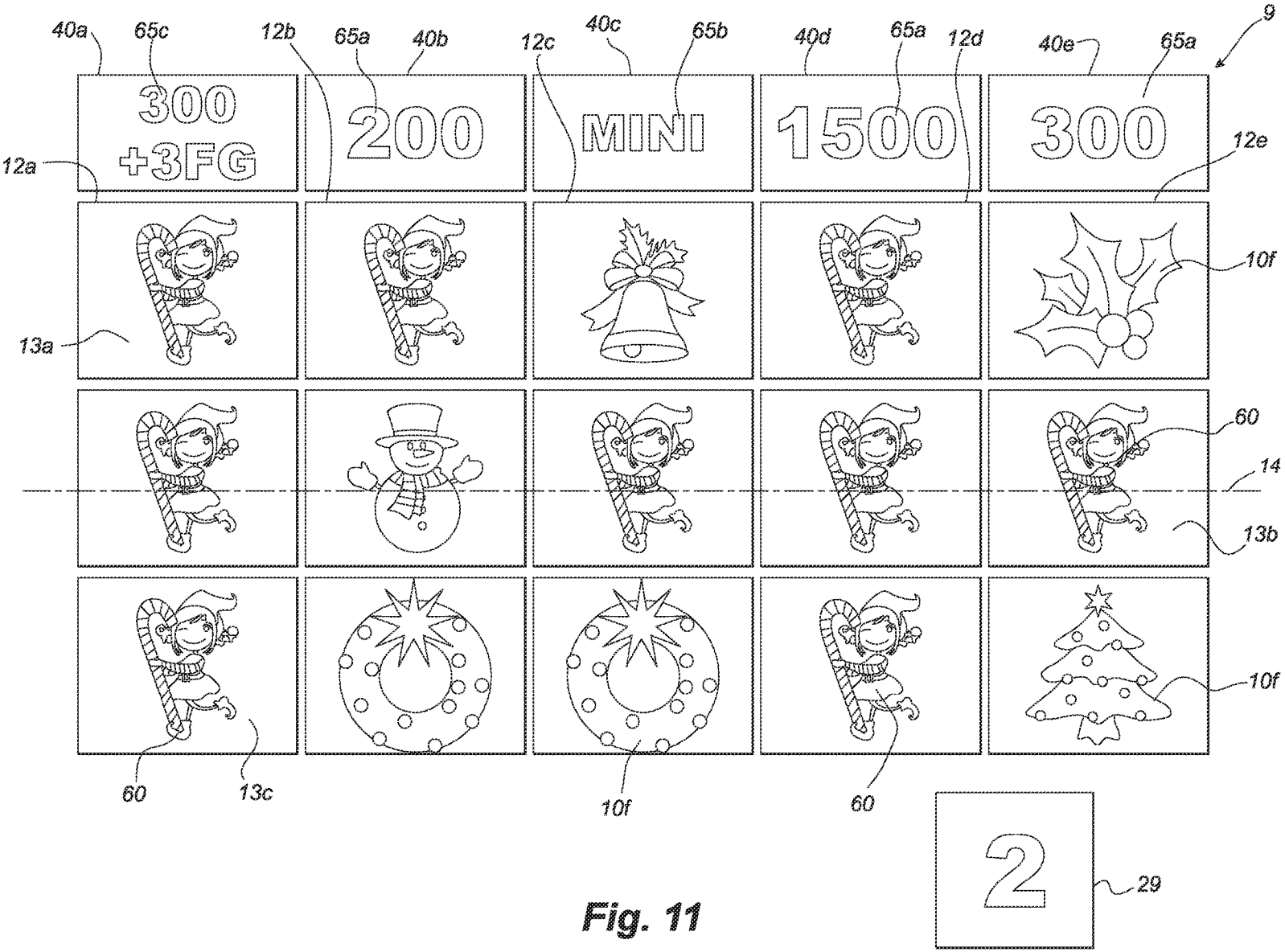

FIG. 11 shows the result of the next free spin, where additional Elf symbols 60 have appeared in the middle game position 13*b* of the reel 12*a*, the top game position 13*a* of the reel 12*d* and the middle game position 13*b* of the reel 12*e*. This causes the bonus positions 40*a*, 40*d* and 40*e* associated with reels 12*a*, 12*d* and 12*e* to change their respective bonus symbols to bonus symbols representing higher game play values. Accordingly, the combined credit and free game bonus symbol 65*c* is now 300+3 FG instead of 200+2 FG, the bonus symbol 65*a* in the bonus position 40*d* is now 1500 instead of 200 and the bonus symbol 65*a* in the bonus position 40*e* is now 300 instead of 150. Moreover, there is an Elf symbol 60 in each game position 13 of the reels 12*a* and 12*d*, causing the electronic game controller to award the game enhancing elements associated with the bonus positions 40*a* and 40*d*. Hence, the player is immediately awarded 300 credits and three free games from completing a stack on the reel 12*a* and 1500 credits for completing the stack in the reel 12*d*.

Figure 12:
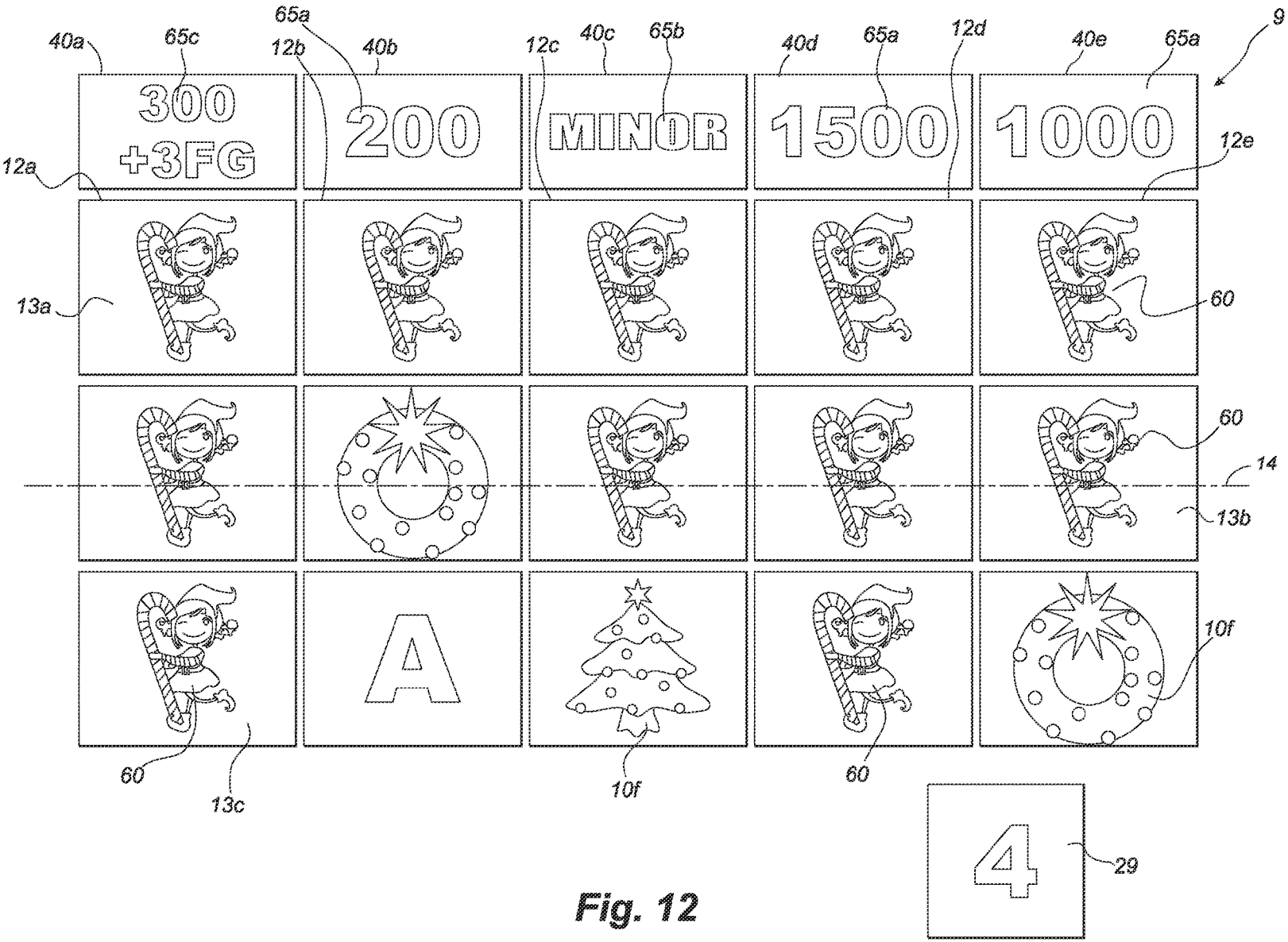

FIG. 12 shows the result of the next free spin, where another two Elf symbols have appeared in the top game positions 13*a* of the reel 12*c* and 12*e*, causing the jackpot bonus symbol 65*b* to change from a MINI to a MINOR in the bonus position 40*c* and the credit bonus symbol 65*a* to change from 300 to 1000. The large jump from 300 to 1000 for the credit bonus symbol 65*a* is due to a higher proportion of game positions 13 that display Elf symbols 60. Where there are a lower number of Elf symbols 60 in the game positions 13 in the reels 12, the change in the game play value of the bonus symbols 65 may be less. Also, the free games counter 29 has been incremented by the three free games awarded in the last spin, to show four free games remaining in the feature game instead of just one.

Figure 13:
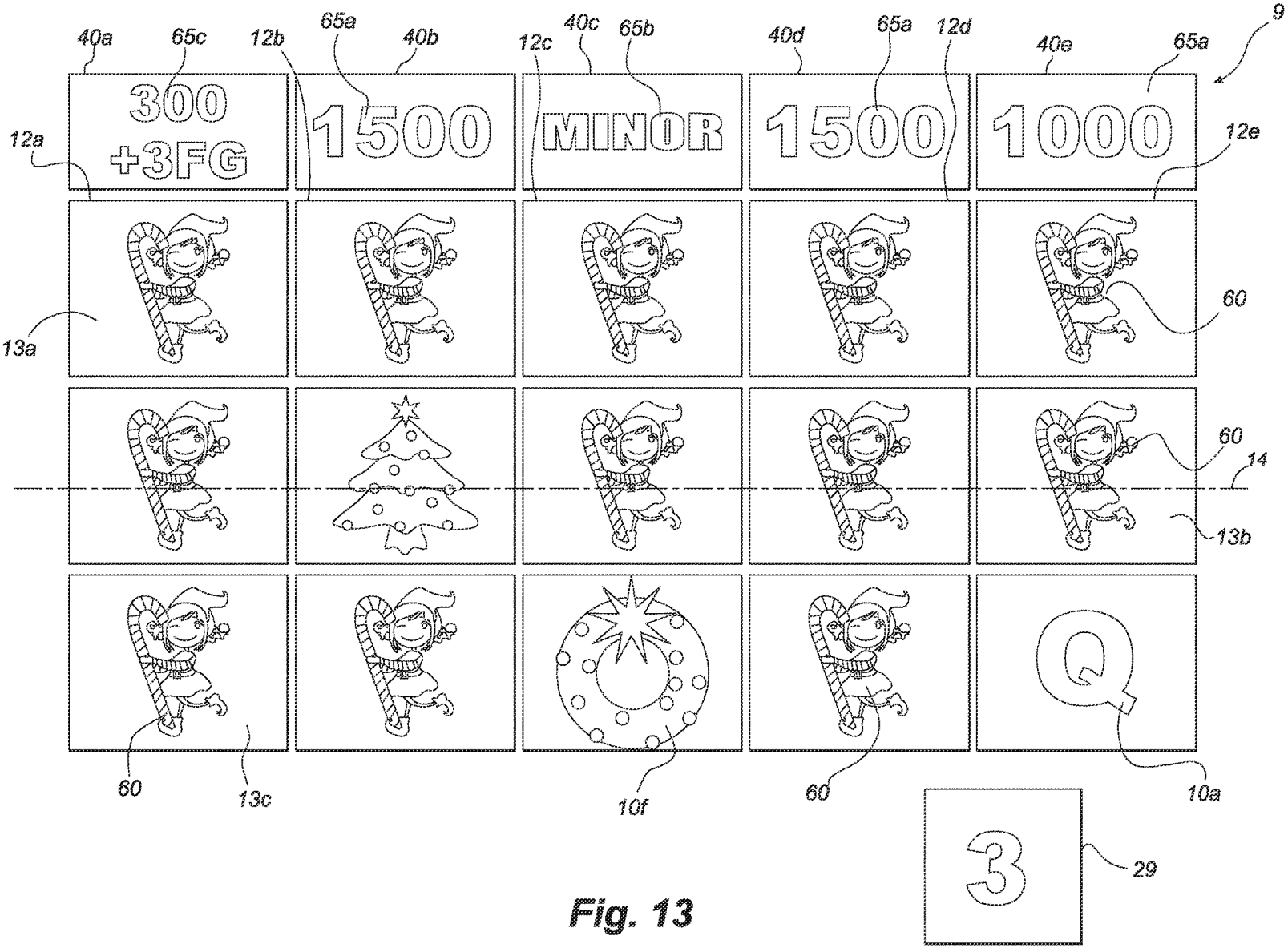
Figure 14:
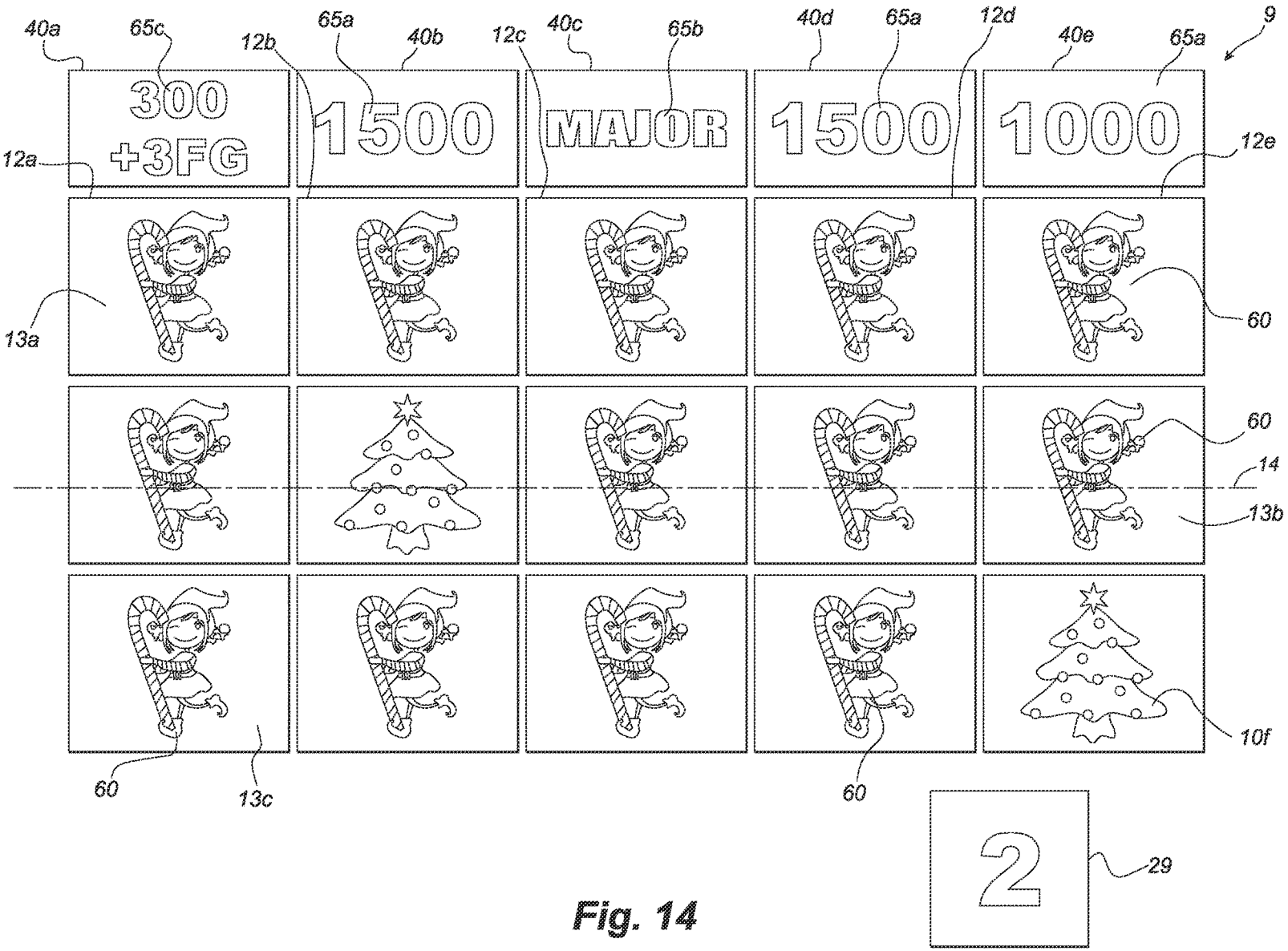
Figure 15:
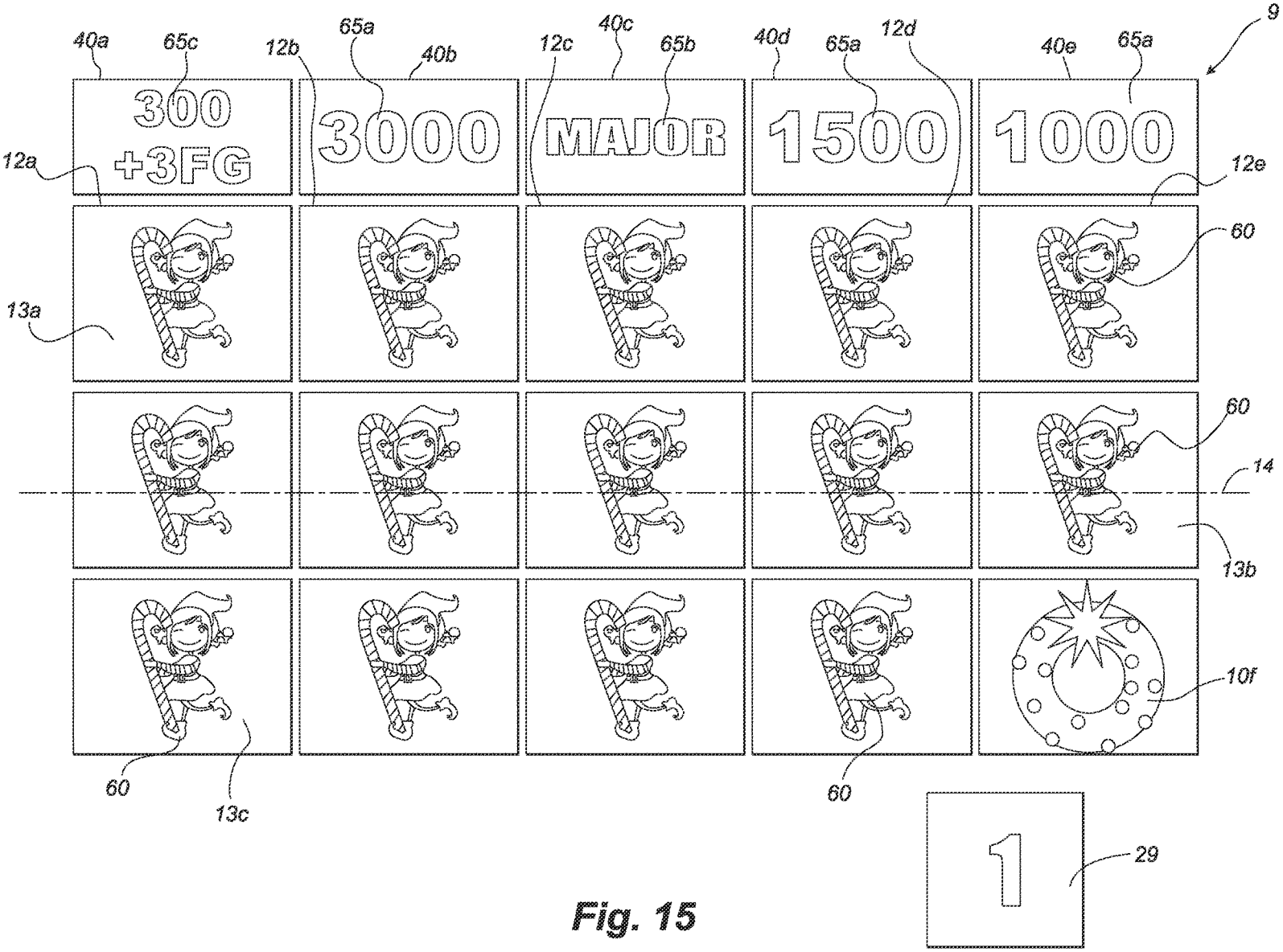

In the next free spin shown in FIG. 13, an additional Elf symbol has appeared in the bottom game position 13*c* of the reel 12*b*, causing the credit bonus symbol 45*a* to change from 200 to 1000. FIG. 14 shows the next free spin, where an Elf symbol has appeared in the bottom game position 13*c* of the reel 12*c*, causing the jackpot bonus symbol 65*b* to change from a MINOR to a MAJOR in the bonus position 40*c* and completing stack of Elf symbols 60 in the reel 12*c*, immediately awarding the player the major progressive jackpot. In FIG. 15 showing the next free spin, an Elf symbol has appeared in the middle game position 13*b* of the reel 12*b*, causing the credit bonus symbol 65*a* to change from a 1500 to 3000 in the bonus position 40*b* and completing the a stack of Elf symbols 60 in the reel 12*b*, immediately awarding the player a credit prize of 3000 credits.

In the next (and final) free spin, if an Elf symbol 60 appears in the remaining bottom game position 13*c* in the reel 12*e*, then the credit bonus symbol 45*a* in the bonus position 12*e* will change from 1000 to 5000 and complete a stack of Elf symbols 60 in the reel 12*e*, immediately awarding the player a credit prize of 3000 credits. Alternatively, as it is the last stack of Elf symbols 60 is completed in the reels 12, then the credit bonus symbol 45*a* in the bonus position 12*e* will change from 1000 to a GRAND jackpot bonus symbol to award the player a grand progressive jackpot as a reward for completely filling the reels 12 with Elf symbols 60. Another alternative is to award the increased credit prize of 5000 credits and award the grand progressive jackpot as a separate reward to completing stacks of Elf symbols 60 in each reel 12.

It will be appreciated that in the present disclosure, the game enhancing element associated with the bonus symbol 45 is awarded immediately and without any determination whether to award the prize. That is, once a stack of the triggering symbols (such as scatter coin symbols 30 or special Elf symbols 60) appear in the associated reels 12*a* to 12*e*, the electronic controller 4 must or always award the game enhancing element associated with the bonus symbol 45 displayed in the bonus position 40 associated with the reel 12*a* to 12*e*. There is no further determination, random or otherwise, whether to award the game enhancing element once the trigger condition has been met.

Thus, the embodiments of the disclosure provide a unique mechanism for the award of game enhancing elements by completing a stack of special symbols (like the coin symbols 30 or special symbols 60) in a reel or column to trigger the award. Hence, by triggering the award of game enhancing elements upon special symbols appearing in each game position of an associated group of game positions, embodiments of the disclosure provide a unique alternative to the award of game enhancing elements to a player compared to existing gaming machines. In addition, the embodiments of the disclosure provide a unique player interface that enables players to quickly ascertain what game enhancing elements can be won during the feature game and the game play value of those game enhancing elements as they increase during the feature game. Thus, the award of game enhancing elements may be performed in an entertaining manner to the player. This overall improves operation of the gaming machine and increases the player's interest as there is more chance of winning additional prizes due to the award of these game enhancing elements.

In some embodiments, different types of game enhancing elements are always displayed in the bonus positions 40*a* to 40*e*. For example, in FIG. 9, the bonus positions 40*a* to 40*e* display bonus symbols 65*a*, 65*b* and 65*c* that represent different types of game enhancing elements to each other—a jackpot-type prize, a free games-type game modifier and a monetary credit prize. In these embodiments, there would not be more than one instance of the same type of game enhancing element. For example, the display of three bonus symbols 65*a* of the same credit prize type in the bonus positions 40*b*, 40*d* and 40*e* shown in FIG. 9 would not be permitted.

In some embodiments, different types of game enhancing elements are associated exclusively with one of the bonus positions 40*a* to 40*e*. For example, the bonus position 40*a* may only display credit prize-type bonus symbols, the bonus position 40*b* only displays jackpot-type bonus symbols, the bonus position 40*c* only displays multiplier-type bonus symbols, the bonus position 40*d* only displays the free games-type bonus symbols and the bonus position 40*e* only displays a combined credit and free games-type bonus symbol.

In other embodiments, the amounts of the credit prizes awarded by associated credit bonus symbols increases as a bet multiplier increases, the bet multiplier being the amount bet by the player per pay line 14. For example, a bet multiplier of 2 means a bet of 2 credits per pay line 14, irrespective of the number of pay lines (2, 5, 10, etc.) that are selected to play the base game 8. Thus, the amounts of the credit prizes will only increase if the bet multiplier increases, irrespective of the amount of the total bet. Similarly, the probability of the jackpot prize being awarded through the jackpot-type bonus symbols also increases with an increase in the total bet made by the player. This may be achieved by using different reel strips with a greater number of jackpot-type bonus symbols for the reels 12*a* to 12*e*.

It will be appreciated that the above described game enhancing elements in FIGS. 5 to 15 are not exhaustive and that other game enhancing elements may be provided. Hence, in some embodiments, the game enhancing element comprises at least one or more a win multiplier, wild multipliers, bonus wilds, symbols that cause the award of additional free games, trigger symbols to retrigger the at least two second arrays, held columns, random wild symbols, stacked symbols, bonus symbols, new game symbols, reveal symbols, progressives, bonus credits, jackpot symbols, and one or more symbol replacements. A variety of game enhancing elements can be awarded by the bonus symbols, including:

- symbols that award a predetermined number of free plays of the game;
- win multiplier symbols that multiply the amount of any win from one of the predetermined winning combinations;
- "wild" symbols that cause the display of substitute symbols in randomly selected symbol positions;
- bonus symbols that awards a bonus prize, either as a monetary amount or as a bonus credit;
- wild multiplier symbols that cause the display of substitute symbols on the array 11 and multiplies the amount of any win from one of the predetermined winning combinations;
- bonus wild symbols that cause the display of substitute symbols on the array 11 and awards a bonus prize;
- symbols that cause the award of additional free plays of the game;
- symbols that cause one or more of the symbol positions to be held static (typically one or more reels 12*a* to 12*e*) and display substitute symbols on the array 11;
- symbols that cause the same game symbol to be stacked in a group of symbol positions, typically the group being one or more reels 12*a* to 12*e;*
- symbols that cause the display of new game symbols on the array 11;
- "reveal" symbols that cause a game symbol to reveal another game symbol; and
- "replacement" symbols that cause one or more game symbols to be replaced by other game symbols in the array 11.

These types of bonus symbols do not modify the function or value of the game symbols 10 that appear on the arrays 11, but instead confer bonus prizes, free games or change existing game symbols for other game symbols (such as replacing picture, royal card or symbols belonging to a reel with wild/substitute symbols). Where the function of game symbols 10 have been changed or the game symbols 10 are replaced, then this modification can take effect with the next play of the game instead of applying to the result of the spun array 11. In another embodiment, the bonus symbols may indicate the duration in which its game enhancing element is applied, such as a predetermined number of spins or a predetermined time period.

It will be appreciated that in other embodiments, the game enhancing elements can also be awarded as a separate aspect of the games 8, 9. The game enhancing elements may further be awarded in addition or as an alternative to the enhanced prizes awarded based on winning combinations of game symbols 10 in the games 8, 9. In a further embodiment, the award of game enhancing elements can be done by way of a sixth reel or the appearance of game enhancing symbols different to the bonus symbols 45, 65 in the reels 12*a* to 12*e*. The sixth reel in this case is simply added as an extension to the array 11 and spins either game enhancing symbols or "blank" symbols.

In some embodiments, the game may include "collector"-type symbols which award points or tokens. The collection of points or tokens during the base game 8 and/or feature game 9 leads to the trigger of additional prizes or game enhancing symbols, depending on the number of points or tokens that are collected. These additional prizes can include stand alone progressive jackpots, bonus prizes and super games, which are enhanced versions of free spins or games where there are greater pay outs or frequency of wins.

In other preferred forms, the game enhancing element can be an enhanced version of the array 11. The enhanced array may provide additional game enhancing symbols that include the award of points or an additional number of free spins of the array 11 (for example, retriggering 5 more free spins). The collection of points awarded by the enhanced array during free spins or game leads to the trigger of additional prizes or game enhancing symbols, depending on the number of points that are collected. These additional prizes can include stand alone progressive jackpots, bonus prizes and super games, which are enhanced versions of free spins or games where there are greater pay outs or frequency of wins. In addition, the enhanced array has a different visual representation to the array 11. In addition, the enhanced array may provide game enhancing symbols of greater value and/or frequency compared to the array 11.

Where the game enhancing element comprises the award of a jackpot prize, such as the Minor, Major and Grand jackpots in FIGS. 5 to 15, it can take the form of a standalone progressive jackpot, fixed jackpot, symbol driven jackpot and any combination thereof (i.e. a mixture of different types of jackpots). In some embodiments, the jackpots are limited to the feature game 9. In other embodiments, the jackpots are shared by all the games 8 and 9. That is, the jackpots could be won through play of the games 8 and 9.

A progressive jackpot prize takes a portion of each bet (typically a set percentage of each bet) made on the gaming machine and thus the amount of the progressive jackpot incrementally increases as more bets are made on the gaming machine 1. The progressive jackpot is typically awarded when a winning game combination associated with the jackpot occurs in the game played on the gaming machine. In many cases, progressive jackpots are associated with the least probable winning combination and are commonly the highest paying award of the gaming machine. In other cases, a separate trigger event can be used to award the progressive jackpot prize, such as a special jackpot symbol, a trigger event internally generated by the electronic controller. Alternatively, or additionally, once a certain threshold is met, either a certain amount that has been bet on the gaming machine or the incremented amount of the progressive jackpot, a trigger event is activated in the electronic gaming machine to pay out the progressive jackpot prize. Progressive jackpot prizes also tend to be shared amongst multiple gaming machines so as to increase the amount of the progressive jackpot prize and hence increase player interest in playing one of the electronic gaming machines. In some gaming machines, more than one jackpot or progressive jackpot are offered by the gaming machine or gaming machines linked together.

Separate jackpot or bonus prizes may also be provided, such as mystery jackpots rather than the symbol driven jackpots awarded through the bonus symbols 45, 65 in the bonus positions 40*a* to 40*e*. That is, none of the symbols in the game trigger the jackpot; hence the trigger event is a "mystery". By way of comparison, a standard jackpot is typically symbol driven in that a particular combination of symbols must occur in the game to trigger the standard jackpot.

The trigger event for the mystery jackpot can be one randomly generated by the electronic controller 4 for each play of the games 8 and 9. One way to implement the random determination of the trigger event is for the electronic controller 4 to internally generate a random number using the random number generator 4*e* and check if it is a predetermined number or within a predetermined range of numbers that will initiate the appearance of the trigger symbols. For example, the predetermined range of numbers could be the range of numbers between 1 and 10 and the electronic controller 4 uses the random number generator 4*e* to internally generate a random number between 1 and 100. If the generated number is any one of numbers 1 to 10, then this results in the electronic controller 4 causing the trigger event to occur and award the progressive jackpot prize. It will be appreciated that this manner of determining the trigger event may also be used to determine whether the feature game 9 is triggered in the base game 8.

Progressive jackpots can be confined to the gaming machine 1 as so called "standalone" progressive jackpots. Alternatively, the jackpot is a wide area or an in-house linked progressive jackpot prize. In other embodiments, one or more the progressive jackpot prizes are configured to be part of a wide area or in-house linked progressive jackpot prize. In other words, the progressive jackpot prizes can be awarded on a group of networked gaming machines in a specified area or a group of specified gaming machines that are linked together for jackpot purposes (usually via a central jackpot controller). The jackpot prizes can also be shared with any other games offered on the same gaming machine 1 (as in multi-game gaming machines).

During play of the games 8 and 9, the electronic controller 4 will determine whether the trigger event for the jackpot has occurred. In response to the occurrence of the jackpot trigger event(s), the electronic controller 4 transmits a signal to the video screen 7 to cause the jackpot(s) associated with the jackpot trigger event(s) to be awarded to the player. After the jackpot(s) are awarded, the amounts for any awarded jackpots are reset. The amounts of the jackpots that have been won can be reset either to a predetermined start amount or simply increment upwardly from zero where the won jackpot is a progressive jackpot.

In some embodiments, the in-game trigger event is determined at the end or during the play of the game; i.e. at the end or during a spin of the reels 12. In some embodiments, the in-game trigger event occurs in a preceding play of the game so that the result of the in-game trigger event takes place in a subsequent play of the game, typically the next play of the game after the preceding play but could include a later successive play of the game.

Figure 16:
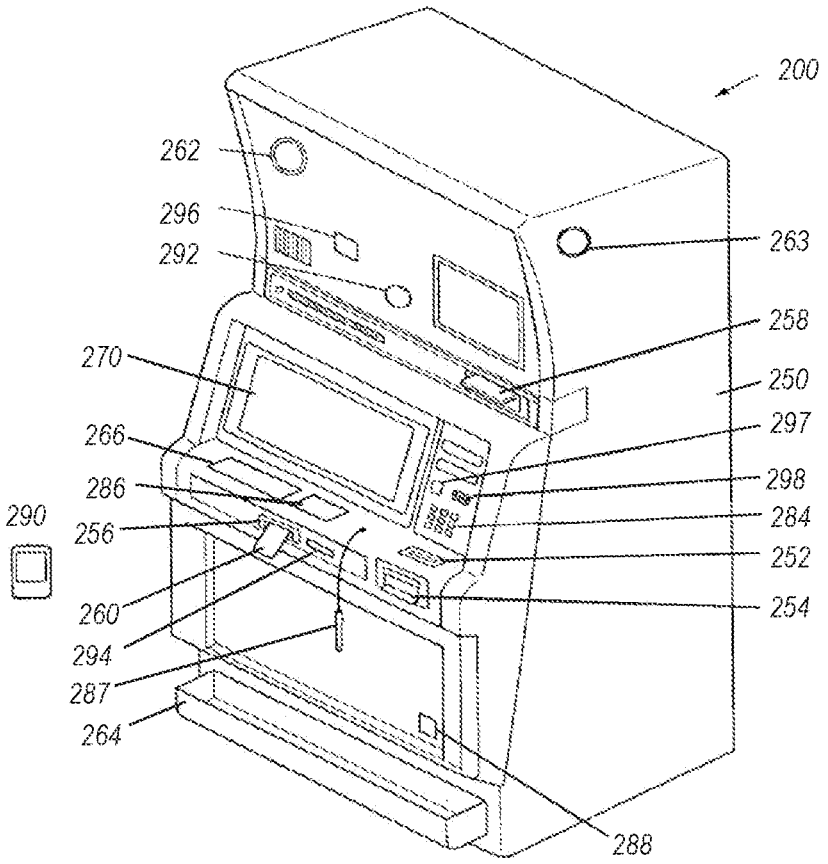
FIG. 16 is a perspective view of an electronic gaming machine according to yet another embodiment of the present disclosure.

Referring to FIG. 16, another embodiment of the present disclosure is shown in the form of an electronic gaming machine 200. The electronic gaming machine 200 may include a housing or cabinet 250 and one or more value transfer mechanisms or devices, which may include a coin slot or acceptor 252, a paper currency or bill acceptor 254, a ticket reader/printer 256 and a card reader 258, which may be used to input value to the electronic gaming machine 200. A value transfer device may include any device that can accept value from a player. The topper (not shown) may be mounted to the top of the electronic gaming machine 200.

If provided on the electronic gaming machine 200, the ticket reader/printer 256 may be used to read and/or print or otherwise encode ticket vouchers 260. The ticket vouchers 260 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 260 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 260 could be printed with an optically readable material such as ink, or data on the ticket vouchers 260 could be magnetically encoded. The ticket reader/printer 256 may be provided with the ability to both read and print ticket vouchers 260, or it may be provided with the ability to only read or only print or encode ticket vouchers 260. In the latter case, for example, some of the electronic gaming machines 200 may have ticket printers 256 that may be used to print ticket vouchers 260, which could then be used by a player in other electronic gaming machines 200 that have ticket readers 256.

If provided, the card reader 258 may include any type of card reading device, such as a magnetic card reader or an optical card reader, and may be used to read data from a card offered by a player, such as a credit card or a player tracking card. If provided for player tracking purposes, the card reader 258 may be used to read data from, and/or write data to, player tracking cards that are capable of storing data representing the identity of a player, the identity of a casino, the player's gaming habits, etc.

The electronic gaming machine 200 may include one or more audio speakers 262, a coin payout tray 264, an input control panel 266, and a colour video display unit 270 for displaying images relating to the game or games provided by the electronic gaming machine 200. The audio speakers 262 may generate audio representing sounds such as the noise of spinning reels, a dealer's voice, music, announcements or any other audio related to a game. The input control panel 266 may be provided with a plurality of pushbuttons or touch-sensitive areas that may be pressed by a player to select games, make wagers, make gaming decisions, etc.

Figure 17:
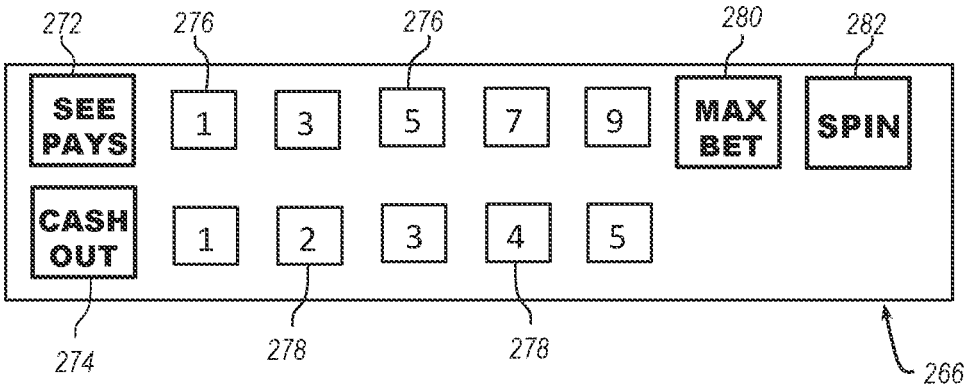
FIG. 17 is a schematic drawing of a control panel for the electronic gaming machine of FIG. 16.

FIG. 17 illustrates one possible embodiment of the control panel 266, which may be used where the electronic gaming machine 200 having a plurality of reels. The control panel 266 may include a "See Pays" button 272 that, when activated, causes the display unit 270 to generate one or more display screens showing the odds or payout information for the game or games provided by the electronic gaming machine 200. As used herein, the term "button" is intended to encompass any device that allows a player to make an input, such as an input device that must be depressed to make an input selection or a display area that a player may simply touch. The control panel 266 may include a "Cash Out" button 274 that may be activated when a player decides to terminate play on the electronic gaming machine 200, in which case the electronic gaming machine 200 may return value to the player, such as by returning a number of coins to the player via the payout tray 264.

The control panel 266 may be provided with a plurality of selection buttons 276, each of which allows the player to select a different number of pay lines prior to spinning the reels. For example, five buttons 276 may be provided, each of which may allow a player to select one, three, five, seven or nine pay lines.

The control panel 266 may also be provided with a plurality of selection buttons 78 each of which allows a player to specify a wager amount for each pay line selected. For example, the electronic gaming machine 200 may be provided with five selection buttons 78, each of which may allow a player to select 1¢, 2¢, 5¢, 10¢ and 20¢, to wager for each pay line selected. In that case, if a player were to activate one of the buttons 276 to select five pay lines and then activate one of the buttons 278 to select 5¢ per pay line to be wagered or bet, the total wager would be $0.25.

The control panel 266 may include a "Max Bet" button 280 to allow a player to make the maximum wager allowable for a game. In the above example, where up to nine pay lines were provided and up to 20¢ could be wagered for each pay line selected, the maximum wager would be $1.80 The control panel 266 may include a spin button 282 to allow the player to initiate spinning of the reels after a bet has been made.

In FIG. 17, a rectangle is shown around the buttons 272, 274, 276, 278, 280, 282. It should be understood that the rectangle simply designates, for ease of reference, an area in which the buttons 272, 274, 276, 278, 280, 282 may be located. Consequently, the term "control panel" should not be construed to imply that a panel or plate separate from the housing 250 of the electronic gaming machine 200 is required, and the term "control panel" may encompass a plurality or grouping of player activatable buttons.

Although one possible control panel 266 is described above, it should be understood that different buttons could be utilized in the control panel 266, and that the particular buttons used may depend on the game or games that could be played on the electronic gaming machine 200. Although the control panel 266 is shown to be separate from the display unit 270, it should be understood that the control panel 266 could be generated by the display unit 270. In that case, each of the buttons of the control panel 266 could be a coloured area generated by the display unit 270, and some type of mechanism may be associated with the display unit 270 to detect when each of the buttons was touched, such as a touch-sensitive screen.

As noted above, the electronic gaming machine 200 may include a mechanism by which the electronic gaming machine 200 may determine the identity of the player. In particular, the card reader 258 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 200 may also include equipment, such as a keypad 284, an input pad 286 (with optional stylus 287), a port (or antenna) 288 adapted to communicate via a wired or wireless link (infrared or radio frequency link, for example) to a mobile electronic device 290 (such as a personal digital assistant, smart phone or tablet), a camera 292, a scanner 294, a retinal (or iris) scanner 296, fingerprint scanner 297, and/or a microphone 298. The electronic gaming machine 200 may include any one of the devices 258, 284, 286, 288, 290, 292, 294, 296, 297, 298, or the electronic gaming machine 200 may include a combination of some or all of the devices 258, 284, 286, 287, 288, 290, 292, 294, 296, 297, 298.

In operation, a player may identify him or herself to the electronic gaming machine 200 by entering a unique numeric or alpha-numeric code using the key pad 284, for example. Alternatively, the player may use his or her finger or the stylus 287 to sign his or her signature on the input pad 286. As a further alternative, the player may sign his or her signature on the mobile electronic device 290, which signature is then converted to electronic data, and the data is then transferred via the port/antenna 288 to the electronic gaming machine 200. As yet another alternative, the player may sign his or her signature on a piece of paper that is then photographed using the camera 292 or scanned using the scanner 294 (or the bill acceptor 254) to convert the signature into electronic data. As an additional alternative, the player may place one of his or her fingers or his or her hand on the scanner 297, and the scanner 297 may generate an electronic data representation of the fingerprint on one or more of the player's fingers or an electronic data representation of the pattern of the entire hand. Alternatively, the camera 292 may be used to take a picture (live or still) of the player, the picture then being converted into electronic data. As a still further alternative, the player may place his or her eye up to the retinal (or iris) scanner 296, and the retinal (or iris) scanner 296 may generate an electronic data representation corresponding to the pattern of the retina (or iris) of the player. As yet another alternative, the player may speak into the microphone 298, and characteristics of the spoken words (or voiceprint) may be converted into an electronic data representation.

Figure 18:
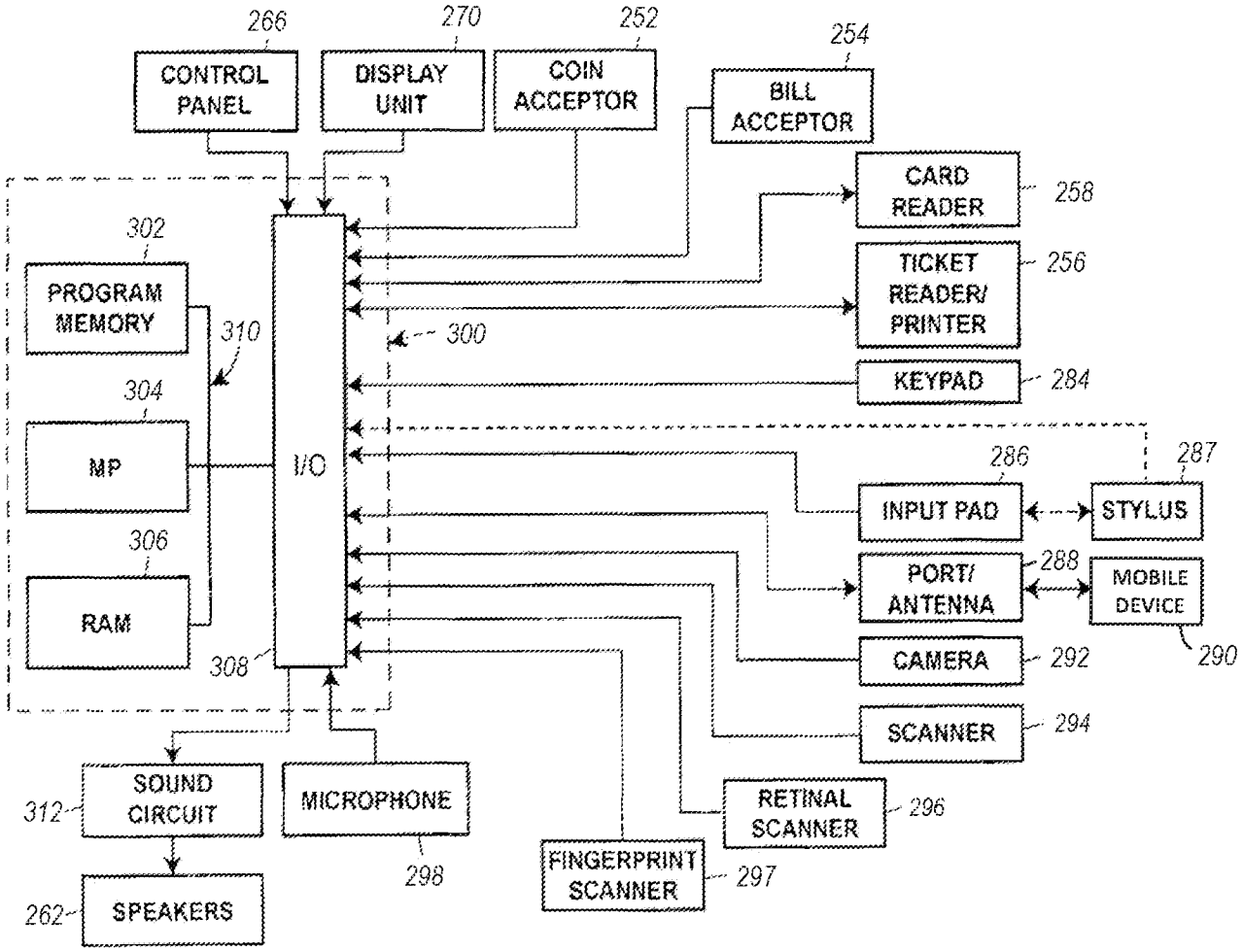
FIG. 18 is a block diagram of the electronic components of the electronic gaming machine of FIG. 16.

FIG. 18 is a block diagram of a number of components that may be incorporated in the electronic gaming machine 200. Referring to FIG. 18, the electronic gaming machine 200 may include a controller 300 that may comprise a program memory 302, a microcontroller or microprocessor (MP) 304, a random-access memory (RAM) 306 and an input/output (I/O) circuit 308, all of which may be interconnected via an address/data bus 310. It should be appreciated that although only one microprocessor 304 is shown, the controller 300 may include multiple microprocessors 304. Similarly, the memory of the controller 300 may include multiple RAMs 306 and multiple program memories 302. Although the I/O circuit 108 is shown as a single block, it should be appreciated that the I/O circuit 308 may include a number of different types of I/O circuits. The RAM(s) 304 and program memories 302 may be implemented as semiconductor memories, magnetically readable memories, and/or optically readable memories, for example.

FIG. 18 illustrates that the coin acceptor 252, the bill acceptor 254, the ticket reader/printer 256, the card reader 258, the control panel 266, the display unit 270, the keypad 284, the input pad 286 (and optionally the stylus 287), the port/antenna 288, the digital camera 292, the scanner 294, the retinal scanner 296, the fingerprint scanner 297 and the microphone 298 may be operatively coupled to the I/O circuit 308, each of those components being so coupled by either a unidirectional or bidirectional, single-line or multiple-line data link, which may depend on the design of the component that is used. The speaker(s) 262 may be operatively coupled to a sound circuit 312, that may comprise a voice- and sound-synthesis circuit or that may comprise a driver circuit. The sound-generating circuit 312 may be coupled to the I/O circuit 308.

As shown in FIG. 18, the components 252, 254, 256, 258, 266, 270, 284, 286, 287, 288, 292, 294, 296, 297, 298, 312 may be connected to the I/O circuit 308 via a respective direct line or conductor. Different connection schemes could be used. For example, one or more of the components shown in FIG. 17 may be connected to the I/O circuit 308 via a common bus or other data link that is shared by a number of components. Furthermore, some of the components may be directly connected to the microprocessor 304 without passing through the I/O circuit 308.

Furthermore, the embodiments of the present disclosure have been described as providing a standard 5×3 array for the base game 8 and the feature game 9. However, it will be appreciated that in other embodiments, the size and shape of the base game array 11 and feature game array may vary as desired. For example, the arrays 11 could take any number of different shapes, such as triangular, circular, square, hexagonal, hemi-spherical or other polygonal shapes. For example, the base game array 11 could comprise a circular array having three rings (equivalent to rows) like a bullseye target segmented into five columns. The feature game array would then expand into additional rings surrounding the initial rings of the base game array 11. Alternatively, the arrays 11 could have an unequal number of rows or columns. For example, the reels 12*a*, 12*b* could have three rows, but the reels 12*c* to 12*e* could have four rows.

While the preferred embodiments of the present disclosure have been described in relation to a feature game 9, those skilled in the art will appreciate that the use of the bonus positions 40*a* to 40*e* to award game enhancing elements can readily be applied to the base game 8 alone or to both a base game 8 and a feature game 9.

In some embodiments, the frequency of the trigger symbols (i.e. scatter coin symbols 30 or special symbols 60) is controlled by choosing different reel strips to display the game symbols 10 in the base game 8. Thus, more coin symbols 30 or special symbols 60 appear on the reels 12 as the bet made by the player increases. This means that the frequency of awarding a game enhancing element increases. There may also be a combination of frequency of the coin symbols 30 or special symbol 60 and using different reel strips with different bonus prizes. Other embodiments may use a free spins bonus where the bonus or jackpot prize values are determined by the player's initiating bet multiplier as well as which free spin is being played or by how many special symbols have been collected or accumulated in the free spins so far.

In some embodiments, the gaming machine comprises an input device for receiving commands from the player to play the game, wherein the input device comprises one or more buttons in electronic communication with the controller to transmit the player commands to the controller. In other embodiments, the buttons comprise physical buttons on the gaming machine, virtual buttons on the display or a combination of both.

In some embodiments, the input device comprises one or more buttons on the housing, the buttons being in electronic communication with the controller. In other embodiments, the buttons are arranged on a console of the housing. Alternatively or additionally, the input device comprises a touch sensitive surface on the display for receiving commands from the player, the touch sensitive surface being in electronic communication with the electronic controller to transmit the player commands to the controller.

In some embodiments, the gaming machine comprises a value transfer mechanism for receiving value from the player to make a bet and initiate a play of the game. In other embodiments, the value transfer mechanism also pays the prizes to the player using value in an amount equal to an awarded prize. It is further preferred that the housing comprises the value transfer mechanism. In one embodiment, the value transfer mechanism comprises one or more vending slots for paying and/or receiving value. In other embodiments, the value transfer mechanism comprises a value input/value output device. In further embodiments, the value transfer mechanism comprises a coin slot or acceptor, a paper currency or bill acceptor, a ticket reader and/or printer or a card reader and/or writer.

Preferably, each bonus position is associated with one of the groups in the array. In some embodiments, the bonus positions are each shown on the display adjacent to its associated group. In other embodiments, the bonus positions are located above the array on the display, each bonus position being adjacent to its associated group.

Preferably, there is a bonus position for each group in the array. Alternatively, there are less bonus positions than groups in the array. In one embodiment, each bonus position is associated with at least one reel. In some embodiments, the groups comprise reels in the array. In other embodiments, there are at least five bonus positions in the array and the groups comprise reels in the array, each bonus position being associated with at least one reel.

Preferably, the bonus symbols displayed in the bonus positions change between plays of the game. In some embodiments, the bonus symbol displayed in the bonus position becomes fixed between plays of the game when a special symbol is displayed at least one game position of the at least one group associated with the bonus position. In other embodiments, the bonus symbols displayed in the bonus positions change where the special symbol is displayed in one or more game positions of the at least one group associated with the bonus positions.

In one embodiment, the game enhancing element associated with the at least one bonus symbol comprises a credit prize, and the amount of the credit prize increases for each game position of the at least one group that is occupied by the special symbol. In another embodiment, the game enhancing element associated with the at least one bonus symbol comprises a credit prize, and the amount of the credit prize increases for each game position in the array that is occupied by the special symbol. In a further embodiment, the game enhancing element associated with at least one bonus symbol comprises a jackpot prize.

Preferably, the controller is configured so that any special symbols appearing in game positions in a play of the game are displayed in the same game positions for one or more subsequent plays of the game. In some embodiments, the special symbols are displayed in the same game positions until the end of the game.

In some embodiments, the game enhancing element is immediately awarded to the player during the game. In other embodiments, the game enhancing element is awarded to the player at the end of the game.

Preferably, a predetermined number of retrigger symbols appearing in game positions in the array causes the controller to reset the number of plays remaining in the game. In some embodiments, the controller adds a predetermined number of plays. In other embodiments, the controller changes the number of play to a predetermined number.

In some embodiments, the bonus positions each display a bonus symbol that awards a different type of game enhancing element for any one play of the game. In other embodiments, each bonus position is associated with a different type of game enhancing element.

In some embodiments, the game enhancing elements comprise at least one or more of a predetermined number of free games, a win multiplier, wild multipliers, bonus wilds, symbols that cause the award of additional free games, trigger symbols to retrigger the game, held columns, random wild symbols, stacked symbols, bonus symbols, new game symbols, reveal symbols, progressives, bonus credits, jackpot symbols, and one or more symbol replacements.

Preferably, the groups comprise reels in the array. In some embodiments, the array comprises five reels. In other embodiments, the reels each comprise three game positions.

Preferably, the one or more of the configurations of the randomly selected game symbols are arranged along a pay line associated with a game outcome. In some embodiments, a play of the game comprises a plurality of randomly selected game symbols arranged in a plurality of reels, one or more of the configurations of the randomly selected game symbols arranged along a pay line being associated with a game outcome, the game outcome being associated with a value award payable to a player.

In some embodiments, the controller comprises an electronic controller coupled to the display. In other embodiments, the controller comprises an electronic controller coupled to at least one electronic video display.

In some embodiments, each the game position comprises a reel separate to the other game positions. That is, each game or symbol position 13 comprises its own individual reel and three of the reels are grouped into columns 12*a* to 12*e* of reels. That is, each symbol position 13 has its own individual reel strip of game symbols.

In other embodiments, the gaming machine 1 also offers the player the opportunity to play in community games against other players in so-called tournament games, or even in player versus player games. This is typically implemented by electronically linking several gaming machines 1 in a group within a gaming venue. The player versus player or tournament game can be played simultaneously by the players or can be staggered, with some players playing at one time and some players playing at another time in the same game. In this situation, the player versus player or tournament game comprises the award of an additional bonus prize in addition to the jackpot prizes in the selected available jackpot set.

While the same game format is essentially used across the base game 8 and feature game 9, it will be appreciated that the game format may vary across the base and feature games, as well as between base games where more than one game is offered by the same electronic gaming machine 1. For example, one of the games 8 may be a wheel-type game or a four reel game and another of the games may be a standard five reel game. Similarly, the games 8 may each have different game symbols, game rules and pay tables that are unique to each game.

While one embodiment of the present disclosure has been described in relation to a base game 8 and a feature game 9, it will be appreciated that embodiments of the present disclosure could include one or more additional feature games that are triggered by specific trigger symbols appearing in the feature game 9. Also, the additional feature games may also have trigger symbols that trigger further feature games in a cascading fashion. These additional and further feature games could have the same game play elements as the feature game 9 or be different feature games entirely.

In some embodiments, the array (including the base game array and/or the feature game array) take any one of a circular, triangular, oval, semi-circular, hexagonal, pentagonal, octagonal, non-rectangular or polygonal shape. In some embodiments, the base game array is different in size and/or dimensions to the feature game array. In other embodiments, the feature game array is greater in size than the base game array. In one preferred form, the base array comprises three rows and five columns and the feature game array comprises either more than three rows or more than five columns. In a further preferred form, the feature game array is an extended base game array.

In some embodiments, a feature game trigger event occurs in the base game to trigger the feature game. In one embodiment, the feature game trigger event comprises a random event determined by the electronic controller at the start of play of the feature game. In another embodiment, the feature game trigger event comprises the appearance of at least one trigger symbol in the base game array. In another alternative, the feature game trigger event comprises an in-game event during play of the base game.

In other embodiments, the base game 8 and the feature game 9 need not be displayed alternately on a single video screen 7. Instead, they may be displayed on the same video screen 7, with the base game 8 shown in the lower playing area 7*a* and the feature game 9 shown in the upper display area of the video screen 7. Alternatively, the base game 8 and the feature game 9 are shown on separate video screens, with the base game 8 shown in a lower video screen corresponding to the lower playing area 7*a* and the feature game 9 shown in an upper video screen corresponding to the upper display area. Also, the order can be reversed, with the lower playing area 7*a* or video screen showing the feature game 9 and the upper video screen or upper playing area of a single video display screen 7 showing the base game 8.

In another embodiment, the video screen 7 is a touch screen for use in addition to the player-actuatable buttons 6 so as to enable the player to select the bet level (such as bet denominations or bet per pay line 14) as well as other various features, such as making monetary bets for the game, initiating play of any base and feature games played and responding to any messages or requests issued on the gaming machine 1 by the electronic controller 4. In this case, the player may control when the reels 12 start spinning and stop spinning, either individually or collectively, by simply touching the reels 12. Control over spinning of the reels 12 can also be implemented through the buttons 6 on the console 3. This increases player interaction and provide the player with an opportunity to guess when a particular game symbol 10 may appear in the reels 12.

In some embodiments, in response to a feature game trigger event in the base game, the controller causes the display to display game symbols for playing the feature game. Alternatively, the controller causes the display of the feature game and the base game during play of the base game, the feature game being inactive until triggered. In this embodiment, the change in the feature game from being inactive to active may be indicated on the display. This indication may be visual, aural or a combination of both.

In some embodiments, the gaming machine comprises a mobile electronic gaming device. In other embodiments, the mobile electronic gaming device comprises a handheld electronic device. In one preferred form, the handheld electronic device comprises a handheld electronic gaming device or a smart phone. Alternatively, the gaming machine comprises a computer. In other embodiments, the computer is connected to a communication network.

In some embodiments, the game symbols may be used to play a slots-type game. In other embodiments, the game symbols may be used to play a poker-type game. In still other embodiments, the game symbols may be used to play a bingo or keno-type game.

The electronic controller 4 may randomly select the game symbols that appear in or on the array (e.g., using the random number generator 4*e*), each column of the array corresponding to a reel in a mechanical or electromechanical display, and provide an award based on the randomly selected configuration. Alternatively, the machine 1 (or a server associated with the machine 1) may select an outcome from a pool of outcomes, and the machine 1 may display a configuration of symbols in accordance with that outcome, and provide an award in accordance with the outcome.

It will be appreciated that while the preferred embodiments have been described in relation to an industry standard electronic gaming machine, the present disclosure can be readily applied to other types of electronic gaming machines, including a personal computer (standing alone or connected to a communications network, LAN or WAN), mobile electronic devices (such as handheld or portable electronic devices like tablets and smart phones) and other electronic devices capable of displaying a game. In the case of mobile electronic device, in one arrangement it may permit the player to make bets using "virtual" credits that represent a monetary value, but do not require the player to make a monetary transaction. Instead, embodiments of the present disclosure may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the present disclosure is implemented on a personal computer (PC) connected to the internet (wirelessly or not). In one example of the implementation, the PC would access an online casino over the internet to play the game of the present disclosure or the game of the present disclosure would be part of a social networking website. It is also contemplated that the player could also make regular payments to subscribe to continue playing the game on the mobile electronic device, PC or other electronic device.

In an alternative embodiment, the gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the present disclosure includes a computer program configured to perform embodiments of the present disclosure. In this way the present disclosure can be implemented in various ways on a gaming machine. In a further aspect, embodiments of the present disclosure include a gaming system configured comprising a central processing unit (such as a computer or computational processor) configured for communication with a gaming machine to perform embodiments of the present disclosure. In a yet another aspect, embodiments of the present disclosure include a non-transitory computer readable or carrier medium carrying computer executable code that, when executed on a central processing unit configured for communication with a gaming machine, causes the central processing unit to perform embodiments of the present disclosure. In this case, the non-transitory carrier medium includes an external hard drive, a memory device, including a memory card, smart card, a radio frequency identification (RFID) device, USB key, magnetic card or other electronic storage device.

While the illustrated embodiments include an electronic display on which the array of game positions is displayed, it will be recognized that the disclosed embodiments could instead incorporate mechanical or electro-mechanical reels to define the array of game positions. In fact, to the extent that the game positions, game symbols or operation of the gaming machine described herein would require a modification of such mechanical or electro-mechanical reels, it will be recognized that the embodiment represents a change in the structure or operation of a machine, rather than simply a variation in the rules of playing a game. In addition or in the alternative, the variation in the game positions, game symbols or operation of the gaming machine described herein may be viewed as analogous to a method for utilizing a new game apparatus (like a new deck of cards), rather than simply as a new set of rules in and of themselves.

It will further be appreciated that any of the features in the preferred embodiments of the present disclosure can be combined together and are not necessarily applied in isolation from each other. For example, the feature of the player being able to selectively starting or stopping spinning of the reels 12 and the feature of providing separate video screens for the lower playing area 7*a* and upper display area 7*b* can be combined into a single gaming machine 1. Similar combinations of two or more features from the above described embodiments of the present disclosure can be readily made by one skilled in the art.

By providing bonus positions to display bonus symbols that trigger the award of game enhancing elements upon the trigger symbol appearing in each game position of an associated group of game positions, the embodiments of the disclosure provide a unique alternative to the award of game enhancing elements to a player compared to existing gaming machines. In addition, the embodiments of the disclosure provide a unique player interface that enables players to quickly ascertain the game enhancing elements that are available and immediately see the game play value of those game enhancing elements increase during the game. Moreover, the embodiments of the disclosure enables the award of game enhancing elements to be performed in an entertaining manner to the player, improving operation of the gaming machine and increasing the player's interest as there is more chance of winning additional prizes due to the award of these game enhancing elements. Embodiments of the present disclosure also add greater value to a player in terms of the probability of winning a prize and providing greater variety in game play, especially compared to a conventional gaming machine that only has one set of reels and a single feature game. All these advantages of the present disclosure result in the player being more likely to retain interest in continuing to play the same gaming machine due to the variation in game play on the gaming machine. Furthermore, since the controller controls operation of the gaming machine, embodiments of the present disclosure can be readily implemented to existing gaming machines, including EGMs, electro-mechanical or purely mechanical gaming machines as well as other gaming systems. In all these respects, the embodiments of the present disclosure represent a practical and commercially significant improvement over the prior art.

In conclusion, although the preceding text sets forth a detailed description of different embodiments of the present disclosure, it should be understood that the legal scope of the present disclosure is defined by the words of the claims set forth at the end of this patent. The detailed description is to be construed as exemplary only and does not describe every possible embodiment of the present disclosure since describing every possible embodiment would be impractical, if not impossible. Numerous alternative embodiments could be implemented, using either current technology or technology developed after the filing date of this patent, which would still fall within the scope of the claims defining the present disclosure.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The invention claimed is:

1. A gaming machine comprising:

a display for displaying a game, and;

a controller for controlling the display of the game symbols on the display; and a value transfer mechanism for receiving value from the player, wherein the controller is in communication with the value transfer mechanism and the value transfer mechanism comprises at least one of a coin acceptor and a paper currency acceptor;

wherein the controller is configured to:

determine if a wager has been received via the value transfer mechanism;

display a play of the game on the display including one or more configurations of game symbols if the wager has been received, one or more of the configurations of game symbols being associated with a game outcome, the game outcome being associated with a value award payable to a player;

provide an array of game positions in which to display the one or more configurations of game symbols, the game positions being arranged into one or more groups;

provide one or more bonus positions, the bonus positions each displaying a bonus symbol associated with a game enhancing element;

associate at least one bonus position with at least one group;

determine whether a special symbol is displayed in at least one game position of the at least one group;

in response at least to a special symbol displayed in at least one game position of the at least one group, fixing the bonus symbol in the at least one bonus position between plays of the game, and in response to a special symbol displayed in at least one additional game position of the at least one group, changing the bonus symbol in the at least one bonus position in a predefined manner;

determine whether a special symbol is displayed in each game position of the at least one group; and in response to the special symbol being displayed in each game position of the at least one group, always award the game enhancing element associated with the bonus symbol displayed in the at least one bonus position associated with the at least one group.

2. The gaming machine of claim 1, wherein each bonus position is associated with one of said groups.

3. The gaming machine of claim 1, wherein the bonus positions are each shown on the display adjacent to its associated group.

4. The gaming machine of claim 1, wherein there is a bonus position for each group in the array.

5. The gaming machine of claim 1, wherein the bonus symbols displayed in the bonus positions change between plays of the game when no special symbol is displayed in at least one dame position of the at least one group.

6. The gaming machine of claim 1, wherein the game enhancing element associated with the bonus symbol comprises a credit prize, and the amount of the credit prize increases for each game position of the at least one group that is occupied by the special symbol.

7. The gaming machine of claim 1, wherein the game enhancing element associated with the bonus symbol comprises a credit prize, and the amount of the credit prize increases for each game position in the array that is occupied by the special symbol.

8. The gaming machine of claim 1, wherein the game enhancing element associated with bonus symbol comprises a jackpot prize.

9. The gaming machine of claim 1, wherein the controller is configured so that any special symbols appearing in game positions in a play of the game are displayed in the same game positions for one or more subsequent plays of the game.

10. The gaming machine of claim 9, wherein the special symbols are displayed in the same game positions until the end of the game.

11. The gaming machine of claim 1, wherein the game enhancing element is immediately awarded to the player during the game.

12. The gaming machine of claim 1, wherein the game enhancing element is immediately awarded to the player at the end of the game.

13. The gaming machine of claim 1, wherein a predetermined number of retrigger symbols appearing in game positions in the array causes the controller to reset a number of plays remaining in the game.

14. The gaming machine of claim 1, wherein, where there is more than one bonus position and the special symbol appears in each game position of more than one group, the controller must award each game enhancing element associated with the bonus symbols displayed in the bonus positions associated with the groups which display the special symbol in each game position.

15. The gaming machine of claim 1, wherein the groups comprise reels in the array.

16. The gaming machine of claim 1, wherein there are at least five bonus positions in the array and the groups comprise reels in the array, each bonus position being associated with at least one reel.

17. A gaming machine comprising:

at least one video display for displaying a game, and;

a value input comprising at least one of a coin acceptor, a bill acceptor and a ticket reader; and at least one electronic controller coupled to the at least one video display and the value input;

wherein the controller is configured to:

determine if a wager has been received via the value input;

display the game on the display including one or more configurations of game symbols if the wager has been received, one or more of the configurations of game symbols being associated with a game outcome, the game outcome being associated with a value award payable to a player;

provide a plurality of reels comprising game positions for displaying game symbols and the one or more configurations of game symbols;

provide one or more bonus positions, the bonus positions each displaying a bonus symbol associated with a game enhancing element;

associate at least one bonus position with at least one reel;

determine whether a special symbol is displayed in at least one game position of the at least one reel;

in response at least to a special symbol displayed in at least one game position of the at least one reel, fixing the bonus symbol in the at least one bonus position between plays of the game, and in response to a special symbol displayed in at least one additional game position of the at least one reel, changing the bonus symbol in the at least one bonus position in a predefined manner;

determine whether a special symbol is displayed in each game position of the at least one reel; and in response to the special symbol being displayed in each game position of the at least one reel, always award the game enhancing element associated with the bonus symbol displayed in the at least one bonus position associated with the at least one reel.

* * * * *